US008997431B2

(12) United States Patent
Winter

(10) Patent No.: US 8,997,431 B2
(45) Date of Patent: Apr. 7, 2015

(54) DECK SYSTEM AND COMPONENTS THEREOF, AND METHODS OF ASSEMBLING AND DISASSEMBLING DECK SYSTEMS AND COMPONENTS

(71) Applicant: Roger Winter, St. John, IN (US)

(72) Inventor: Roger Winter, St. John, IN (US)

( * ) Notice: Subject to any disclaimer, the term of this patent is extended or adjusted under 35 U.S.C. 154(b) by 0 days.

(21) Appl. No.: 14/517,408

(22) Filed: Oct. 17, 2014

(65) Prior Publication Data

US 2015/0052844 A1 Feb. 26, 2015

Related U.S. Application Data

(63) Continuation of application No. 13/973,757, filed on Aug. 22, 2013, now Pat. No. 8,863,466.

(51) Int. Cl.

| | |
|---|---|
| ***E04B 1/18*** | (2006.01) |
| ***E04C 3/02*** | (2006.01) |
| ***E04C 5/16*** | (2006.01) |

(52) U.S. Cl.

CPC .. *E04C 3/02* (2013.01); *E04C 5/162* (2013.01)

(58) Field of Classification Search

USPC ..... 52/634, 635, 650.1, 650.3, 648.1

See application file for complete search history.

(56) References Cited

U.S. PATENT DOCUMENTS

| | | | | |
|---|---|---|---|---|
| 2,964,807 A | | 12/1960 | Kennedy | |
| 4,572,694 A | * | 2/1986 | Hoeksema | 403/187 |
| 4,622,792 A | * | 11/1986 | Betts | 52/263 |
| 4,823,529 A | * | 4/1989 | Canfield et al. | 52/263 |
| 4,833,842 A | * | 5/1989 | Anastasio | 52/79.6 |
| 5,201,546 A | * | 4/1993 | Lindsay | 280/789 |
| 5,313,756 A | * | 5/1994 | Ways et al. | 52/263 |
| 5,412,915 A | * | 5/1995 | Johnson | 52/177 |
| 5,469,678 A | | 11/1995 | Zamerovsky | |
| 5,483,773 A | * | 1/1996 | Parisien | 52/73 |
| 5,746,958 A | | 5/1998 | Gustafsson et al. | |
| 5,851,469 A | | 12/1998 | Muller et al. | |

(Continued)

OTHER PUBLICATIONS

International Searching Authority, form PCT/ISA/220, Patent Cooperation Treaty, PCT, International Search Report regarding international application no. PCT/US2014/049692, 4 pages, Oct. 15, 2014.

(Continued)

*Primary Examiner* — Mark Wendell
*Assistant Examiner* — Keith Minter
(74) *Attorney, Agent, or Firm* — McDonnell Boehnen Hulbert & Berghoff LLP

(57) ABSTRACT

Deck systems, deck system components making up the deck systems, and methods of assembling and disassembling deck system components and the deck systems are described herein. A box-frame can be assembled from box-frame segments, angle clips, and fasteners. A box-frame can be supported by posts attached to the box-frame using post brackets and fasteners. Joist assemblies can be assembled using joist segments, joist spacers, and fasteners. Joist assemblies can be positioned within the box-frame. The joist assemblies can be secured to box-frame segments or another joist assembly using roll-lock tabs and roll-lock tab receivers and locking tabs and locking tab retainers that part of extrusions making up the box-frame segments, joist spacers, or joist segments. Deck boards can be secured to the joist assemblies using deck screws or deck clips. The post brackets can accommodate support posts below deck boards and railing posts extending above deck boards.

20 Claims, 24 Drawing Sheets

(56) References Cited

U.S. PATENT DOCUMENTS

| | | | | |
|---|---|---|---|---|
| 6,226,941 | B1 * | 5/2001 | Stevens | 52/302.3 |
| 6,237,299 | B1 * | 5/2001 | Gortan | 52/693 |
| 6,250,037 | B1 * | 6/2001 | Ezumi et al. | 52/592.1 |
| 6,385,858 | B1 | 5/2002 | Muller | |
| 6,427,403 | B1 * | 8/2002 | Tambakis | 52/309.1 |
| 6,527,532 | B1 | 3/2003 | Yarmoska et al. | |
| 6,651,398 | B2 * | 11/2003 | Gregori | 52/489.1 |
| 6,872,434 | B2 * | 3/2005 | Zen | 428/36.9 |
| 6,941,715 | B2 * | 9/2005 | Potter | 52/480 |
| D537,537 | S * | 2/2007 | Antonic | D25/122 |
| D540,479 | S * | 4/2007 | Antonic | D25/122 |
| 7,334,372 | B2 * | 2/2008 | Evans et al. | 52/289 |
| 7,353,639 | B2 * | 4/2008 | Carson | 52/79.5 |
| 7,434,358 | B2 * | 10/2008 | Smith | 52/14 |
| 8,166,901 | B2 * | 5/2012 | Gerst et al. | 114/263 |
| 8,245,481 | B1 * | 8/2012 | Flynn | 52/741.11 |
| 8,397,441 | B2 * | 3/2013 | Wallance | 52/79.1 |
| 8,668,407 | B2 * | 3/2014 | Hawkins et al. | 405/218 |
| 8,863,466 | B1 | 10/2014 | Winter | |
| 2002/0059766 | A1 * | 5/2002 | Gregori | 52/489.1 |
| 2003/0014935 | A1 * | 1/2003 | Bodnar | 52/481.1 |
| 2004/0255551 | A1 * | 12/2004 | Fuhr | 52/782.1 |
| 2007/0163205 | A1 | 7/2007 | Johns | |
| 2011/0072744 | A1 * | 3/2011 | Maley et al. | 52/220.1 |
| 2011/0203215 | A1 * | 8/2011 | Mcnamee | 52/650.3 |
| 2011/0225923 | A1 * | 9/2011 | Dueker | 52/650.3 |
| 2011/0283643 | A1 * | 11/2011 | Rubel et al. | 52/327 |
| 2012/0031017 | A1 * | 2/2012 | Stroyer | 52/157 |
| 2012/0311950 | A1 * | 12/2012 | Rubel et al. | 52/414 |
| 2013/0198978 | A1 | 8/2013 | Pohlman et al. | |

OTHER PUBLICATIONS

International Searching Authority, form PCT/ISA/237, Written Opinion of the International Searching Authority regarding International Application No. PCT/US2014/049692, 6 pages, Oct. 15, 2014.

Kawneer Company, Inc, Parwall Features, EC 96253-15, 6 pages, May 2011.

Tubelite Inc., 200 Series Curtainwall Description, 36 pages, 2007.

Tubelite, Inc., Storefronts and Entrances, 12 pages, Oct. 11, 2012.

Tubelite, Inc., Sunshades by Tubelite, 4 pages, Nov. 7, 2011.

Tubelite, Inc., Standard and Custom Entrances, 2 pages, Jan. 22, 2013.

Tubelite, Inc., Curtainwall, 4 pages, Apr. 23, 2013.

Wikipedia, Deck (building), 4 pages, downloaded from the World Wide Web at http://en.wikipedia.org/wiki/Deck_(building) on Jul. 30, 2013.

Tubelite, Inc., Standard Entrances Description, 47 pages, 2007.

* cited by examiner

DECK SYSTEM AND COMPONENTS THEREOF, AND METHODS OF ASSEMBLING AND DISASSEMBLING DECK SYSTEMS AND COMPONENTS

This application is a continuation application of U.S. patent application Ser. No. 13/973,757 filed on Aug. 22, 2013, which is incorporated by reference herein in its entirety.

BACKGROUND

A deck is a structure typically built outdoors and typically connected to a building. A deck usually has a flat surface similar to a floor and can be built at a given elevation above the ground. A deck can support a load consisting of people, deck furniture, or other items. The supportable load can vary from deck to deck based on such items as the size and type of material used to build the deck.

OVERVIEW

Example embodiments pertaining to deck systems and components thereof, as well as example embodiments of assembling and dissembling deck systems and components are described herein. One or more of the example embodiments can provide for deck system components or deck systems that are easier to assemble, disassemble, and reassemble than prior decks. One or more of the example embodiments provide for disassembling an assembled deck system, moving the disassembled deck system from a first location to a second location, such as a storage building, and subsequently reassembling the deck system at the first location, the second location, or a third location. Disassembly of the deck system can occur for storage of the components within the storage building during an expected time-frame when the deck system will not be used (such as winter time) or for some other reason.

In one respect, one or more example embodiments can be arranged as a deck system comprising: (i) a first perimeter box-frame comprising a first box-frame segment (BFS), a second BFS, a third BFS, and a fourth BFS, wherein the first BFS is removably attached to the second BFS and to the third BFS, wherein the second BFS is removably attached to the first BFS and to the fourth BFS, wherein the third BFS is removably attached to the first BFS and to the fourth BFS, and wherein the fourth BFS is removably attached to the second BFS and to the third BFS, and (ii) one or more joist assemblies removably attached to and within the perimeter box-frame, wherein each joist assembly comprises two joist segments and two joist spacers between the two joist segments.

In another respect, one or more example embodiments can be arranged as a method comprising: (i) assembling a first perimeter box-frame comprising a first box-frame segment (BFS), a second BFS, a third BFS, and a fourth BFS, wherein the first BFS is removably attached to the second BFS and to the third BFS, wherein the second BFS is removably attached to the first BFS and to the fourth BFS, wherein the third BFS is removably attached to the first BFS and to the fourth BFS, and wherein the fourth BFS is removably attached to the second BFS and to the third BFS, (ii) assembling a plurality of joist assemblies, wherein each joist assembly comprises a first joist spacer, a second joist spacer, a first joist segment, and a second joist segment, wherein the first joist spacer attaches to a first end of the first joist segment and a first end of the second joist segment, and wherein the second joist spacer attaches to a second end of the first joist segment and a second end of the second joist segment, and (iii) attaching the plurality of joist assemblies within the perimeter box frame.

These as well as other aspects and advantages will become apparent to those of ordinary skill in the art by reading the following detailed description, with reference where appropriate to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments are described herein with reference to the drawings, in which.

DETAILED DESCRIPTION

I. Introduction

This description describes several example embodiments including example embodiments regarding deck systems and components thereof. The example deck systems can be used as a free-standing deck positioned on the ground or a deck attached to one or more structures. The example deck systems, or portions thereof, can be installed on land or in water. A deck system having at least a portion installed in water can be referred to as a pier. The example deck system, or portions thereof, can be used as a bridge over a stream, a creek, a ditch, or some other areas of Earth. The example deck systems can be assembled and used at a recreational vehicle (RV) park. The example deck systems can be easily disassembled from one location, moved to another location, and reassembled at the other location.

This description refers to extrusions. The extrusions can be produced by extruding a material through a die. Several of the example embodiments refer to the extrusion material as aluminum. The extrusions of the example embodiments can be a material other than aluminum. Extrusions used within the example deck systems can be cut from a stock length extrusion. One or more of the extrusions can be mitered, punched, or otherwise prepared to receive one or more fasteners, anchors, or other deck system component.

The components, functions, and various views shown in the figures are provided merely as examples and are not intended to be limiting. Elements shown in the various figures having the same reference number can be the same or a similar element. Many of the components illustrated in the figures or described herein as being attached can be attached using any of a variety of fasteners. Some fasteners used to attach two or more components can be a part of the attachable component.

In this description, the articles "a" or "an" are used to introduce elements of the example embodiments. The intent of using those articles is that there is one or more of the elements. The intent of using the conjunction "or" within a described list of at least two terms is to indicate any of the listed terms or any combination of the listed terms. The use of ordinal numbers such as "first," "second," "third" and so on is to distinguish respective elements rather than to denote a particular order of those elements.

II. Example Deck System

Figure 1:
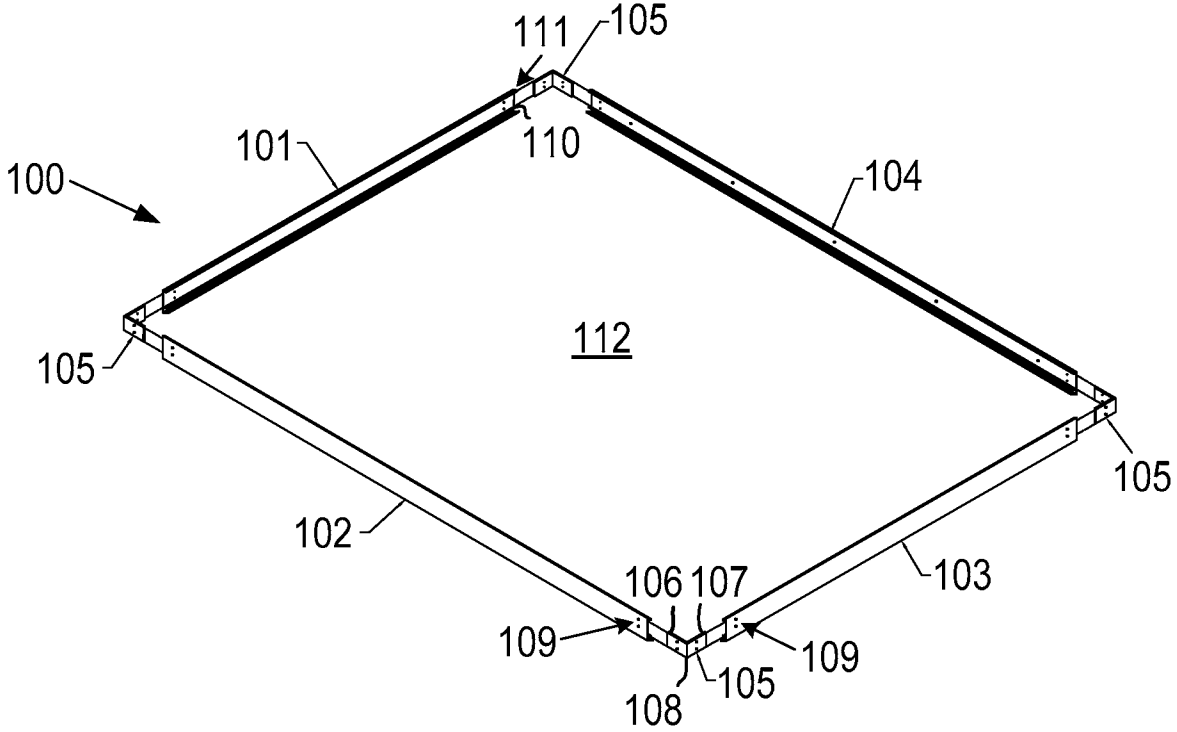
FIG. 1 shows components for assembling a perimeter box-frame of a deck system in accordance with one or more example embodiments.

FIG. 1 shows example components for assembling a perimeter box-frame (or more simply "box-frame") 100 usable within the example deck systems. As shown in FIG. 1, the box-frame components include box-frame segments 101, 102, 103, and 104, and angle clips 105. An area surrounded by box-frame segments 101, 102, 103, and 104 is a box-frame interior 112.

Each angle clip 105 can be arranged as an L-shaped clip having angle clip segments 106 and 107 that extend from joint or bend 108. Each angle clip segment 107 and 108 can include at least one attachment hole. The attachment hole(s) can be through-hole(s). Each attachment hole within angle clip segments 107 and 108 can correspond to a respective attachment hole 109 within box-frame segments 101, 102, 103, and 104. As an example, angle clip 105 can include four attachment holes 109 for securing angle clip 105 to two box-frame segments using four number ten by one inch (i.e., #10×1") flat head sheet metal screws, four lock washers, and four nuts. Angle clips 105 can be made from aluminum or another material.

Each angle clip segment 106 and 107 can slide or otherwise be inserted into a respective box-frame segment. Each box-frame segment can include an angle clip shelf 110 and an angle clip slot 111 for guiding or supporting angle clip 105.

Figure 2:
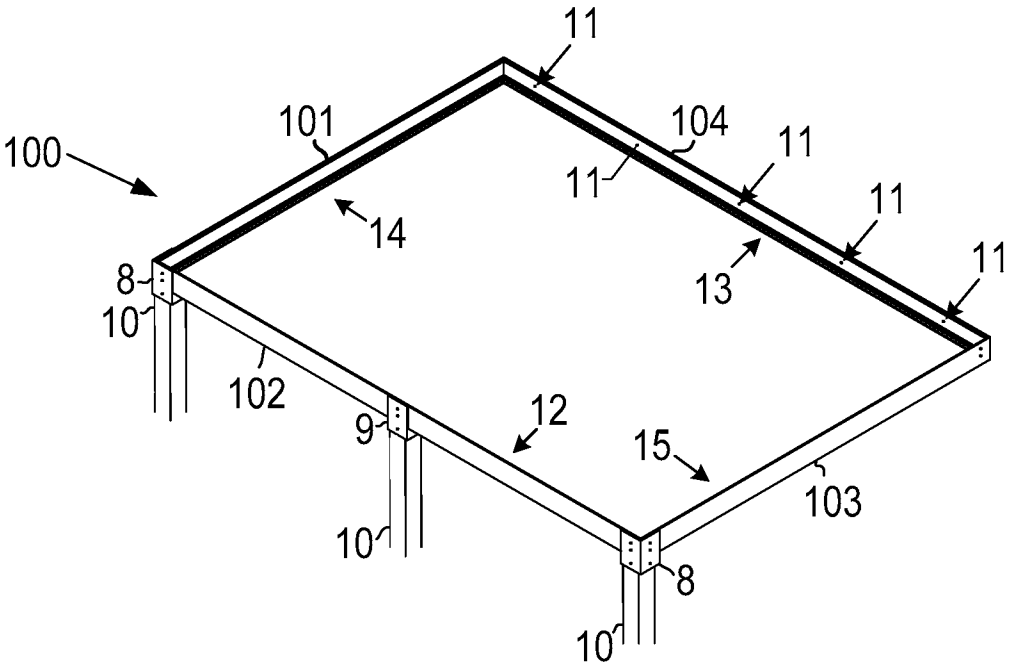
FIG. 2 shows an assembled box-frame in accordance with one or more example embodiments.

Next, FIG. 2 shows box-frame 100 assembled and attached to support-posts (or more simply "posts") 10 on a first side 12 of box-frame 100. Corner-post brackets 8 and an intermediate-post bracket 9 can be used for attaching box-frame 100 to posts 10. Other sides 13, 14, and 15 of box-frame 100 are identified in FIG. 2. Box-frame segment 104 on side 13 can include through-holes 11 for attaching box-frame 100 to another box-frame or to a structure, such as a house or a mobile home. Box-frame segments 101, 102 and 103 can include through-holes arranged similar to through-holes 11, but those through-holes are not shown for clarity of FIG. 2.

The lengths of box-frame segments 101, 102, 103, and 104 can be any of a plurality of lengths. As an example, box-frame segments 101 and 103 can be six foot, zero inches (i.e., 6'-0"). As another example, box-frame segments 102 and 104 can be 10'-0." Other example lengths for the box-frame segments are also possible.

Figure 8:
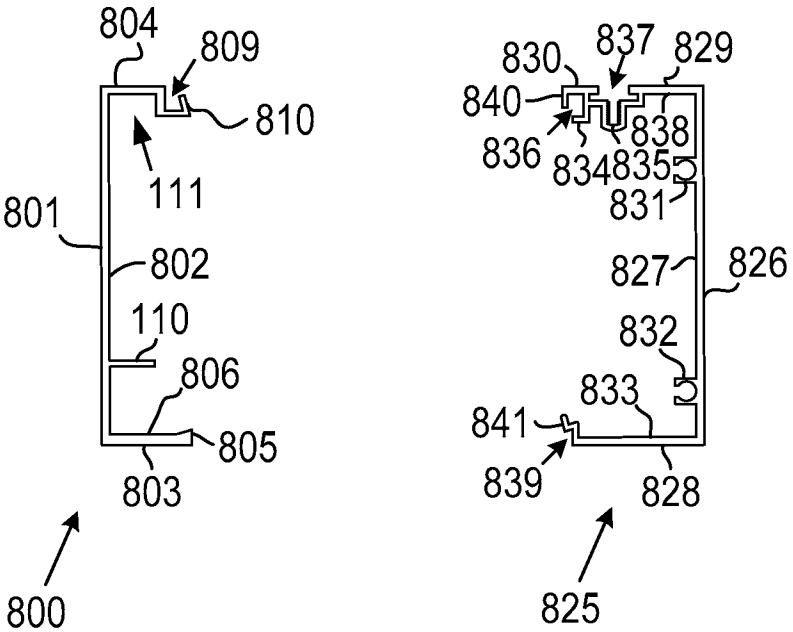
FIG. 8 shows profiles of example extrusions in accordance with one or more example embodiments.
Figure 21:
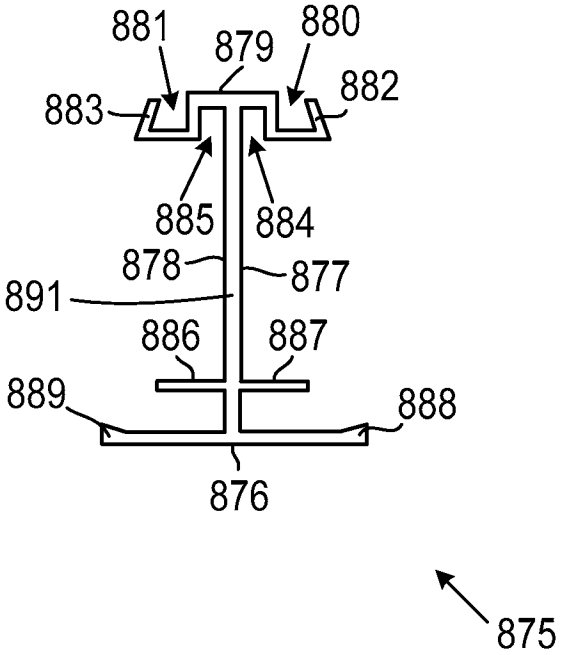
FIG. 21 shows profiles of example extrusions in accordance with one or more example embodiments.
Figure 21:
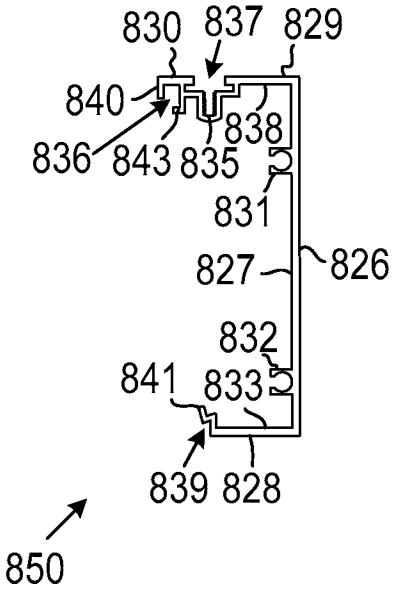

Box-frame segments 101, 102, 103, and 104 can comprise or be configured as any of a variety of extrusions. Profiles of example extrusions 800 and 825 are shown in FIG. 8, and profiles of example extrusions 850 and 875 are shown in FIG. 21. For an example deck system comprising a single box-frame, box-frame segments 101, 102, 103, and 104 can be configured like extrusion 800 arranged with their flat vertical sides as the outer edges of box-frame 100.

In FIG. 2 and in other figures described herein, posts 10 are shown as being rectangular or rectangular prisms. The posts used with the example embodiments do not have to be rectangular. For instance, one or more posts used with the example embodiments can be cylindrical. Post brackets used with non-rectangular posts, such as cylindrical posts, can have non-rectangular shapes, such as cylindrical shapes, to accommodate the non-rectangular posts.

A deck system can comprise two or more box-frames. For an example deck system comprising two or more box-frames configured like box-frame 100, a box-frame segment configured like extrusion 800 from two separate box frames can be bolted together with their flat vertical sides 801 abutting one another.

Figure 22:
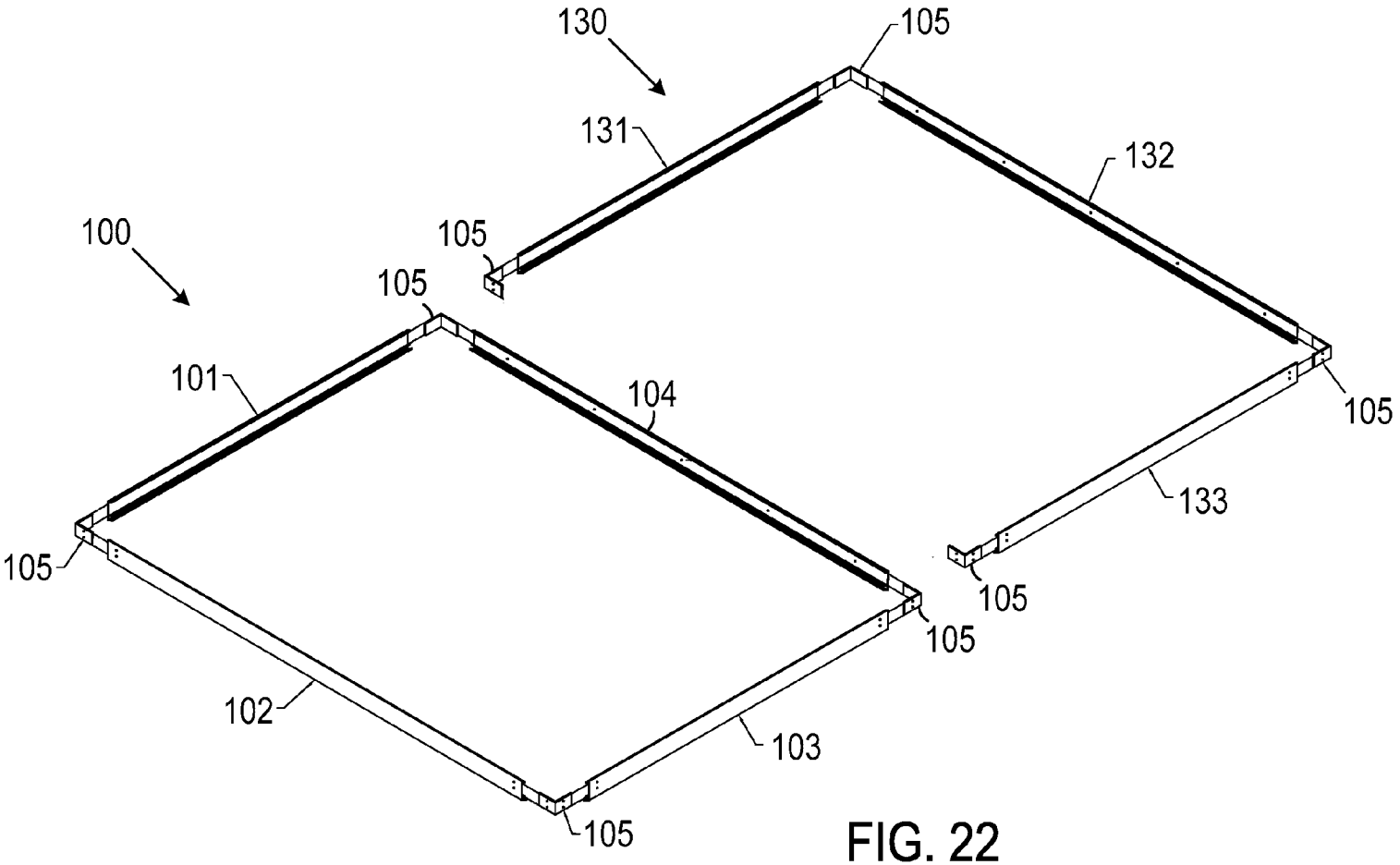
FIG. 22 shows components for assembling a deck system in accordance with one or more example embodiments.

FIG. 22 shows example components for a deck system using two or more box-frame segments. In particular, FIG. 22 shows box-frame segment 100 and a box-frame segment attachment 130 that when connected to another box-frame segment, such as box-frame segment 100, forms another box-frame, such as the box-frame of deck system 705 shown in FIG. 7. Box-frame segment attachment 130 includes box-frame segments 131, 132, and 133. For these example embodiments, box-frame segments 101, 102, 103, 131, 132, and 133 can be configured like extrusion 800, and box-frame segment 104 can be configured like extrusion 875. Box-frame segment attachment 130 can include angle clips 105, two of which can be used for attaching box-frame segment attachment 130 to box-frame 100.

Figure 3:
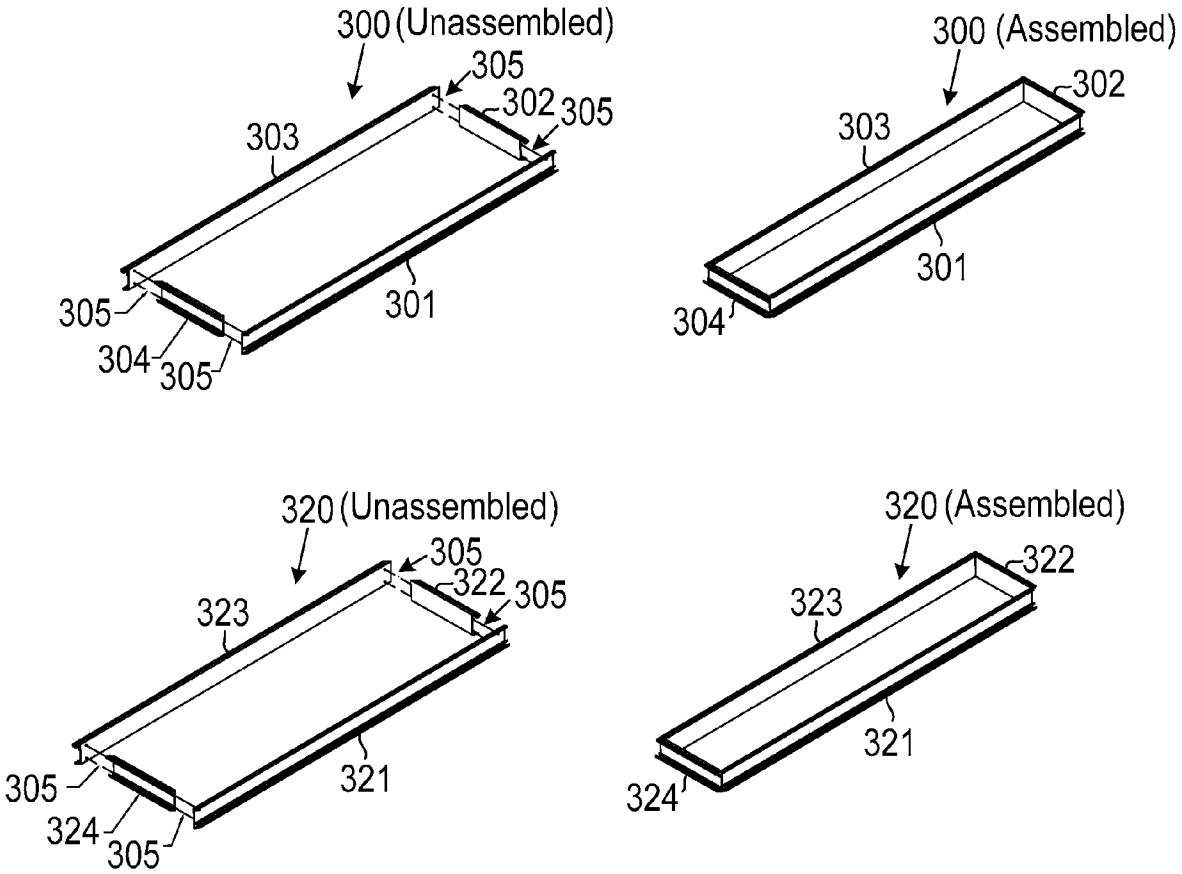
FIG. 3 shows components of joist assemblies in accordance with one or more example embodiments.

Next, FIG. 3 shows example components of joist assemblies 300 and 320 usable within the example deck systems. Joist assemblies 300 and 320 are shown unassembled and assembled. Joist assemblies are attachable to and removable from a box-frame, such as box-frame 100. Joist assemblies are attachable within box-frame interiors, such as box-frame interior 112.

The joist assembly components of joist assembly 300 include joist segments 301, 303, joist spacers 302, 304, and fasteners 305. Joist segment 301 can comprise an aluminum extrusion having a profile like extrusion 800. Joist segment 303 can comprise an aluminum extrusion having a profile like extrusion 825 or 850. Joist spacers 302 and 304 can comprise aluminum extrusions having a profile like extrusion 850. Fasteners 305 can comprise number twelve hex-head sheet metal screws that are one inch long (i.e., #12×1" HH SMS) or some other fastener.

Joist segments 301 and 303 can have a common length, such as 6'-0," or some other length. Joist spacers 302 and 304 can have a common length, such as 1'-2" (i.e., 14 inches), or some other length. The common length of joist spacers 302 and 304 can depend on a thickness of deck boards to be attached to the deck system. The common length of joist segments 301 and 303 is typically a length that allows joist segment 303 to be attached to box-frame segment 101, joist spacer 302 to be attached to box-frame segment 104, and joist spacer 304 to be attached to box-frame segment 102, all within box-frame interior 112 when assembled as joist assembly 300.

The joist assembly components of joist assembly 320 include joist segments 321, 323, joist spacers 322, 324, and fasteners 305. Joist segment 323 can comprise an aluminum extrusion having a profile like extrusion 825 or 850. Joist segment 321 and joist spacers 322 and 324 can comprise aluminum extrusions having a profile like extrusion 850.

Joist segments 321 and 323 can have a common length, such as 6'-0," or some other length. Joist spacers 322 and 324 can have a common length, such as 1'-2" (i.e., 14 inches), or some other length. The common length of joist spacers 322 and 324 can depend on a thickness of deck boards to be attached to the deck system. The common length of joist segments 321 and 323 is typically a length that allows joist segment 321 to be attached to box-frame segment 103, joist spacer 322 to be attached to box-frame segment 104, and joist spacer 304 to be attached to box-frame segment 102, all within box-frame interior 112 when assembled as joist assembly 320. Joist segment 323 can attach to another joist assembly installed with the box-frame interior.

Figure 4:
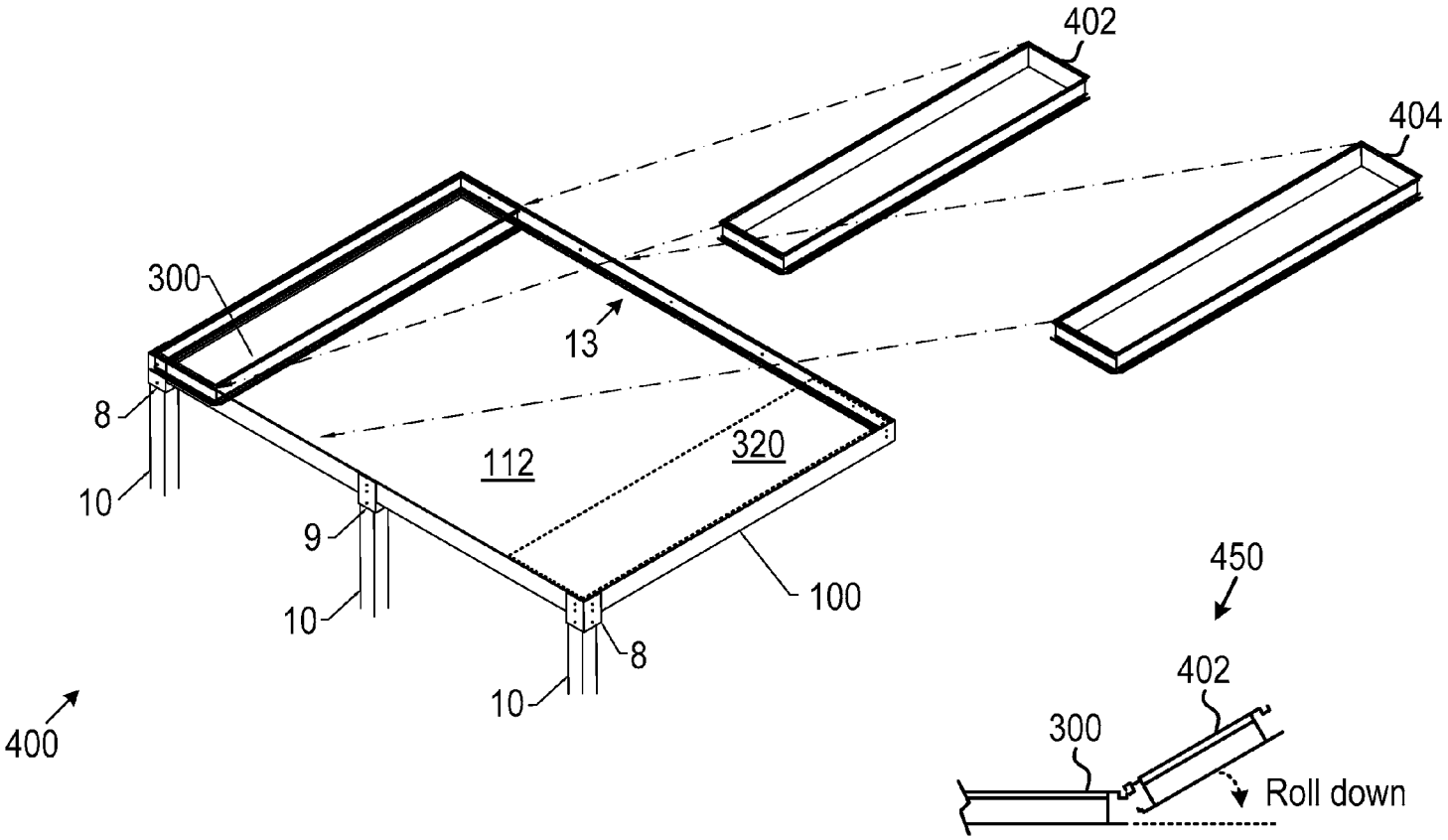
FIG. 4 shows a deck system under construction in accordance with one or more example embodiments.

Next, FIG. 4 shows an example deck system 400 under construction. Deck system 400 includes box-frame 100, joist assembly 300 installed within the interior 112 of box-frame 100, corner-post brackets 8, intermediate-post bracket 9, and posts 10. FIG. 4 also shows additional joist assemblies 402 and joist assembly 404 prior to installation into deck system 400. Joist assemblies 402 and 404 can be arranged like joist assembly 300. The short dashed lines within box-frame 100 represent a location at which joist assembly 320 can be installed into deck system 400, typically after all other joist assemblies to be installed into box-frame 100 have been installed.

In accordance with one or more example embodiments, a first installed joist assembly and all intermediate joist assemblies can be arranged like joist assembly 300, and a last installed joist assembly can be arranged like joist assembly 320. The intermediate joist assemblies are installed between joist assemblies 300 and 320. The portions of two joist segments that abut one another and the portion of a joist segment or joist spacer that abuts a box-frame segment can have, in combination, a roll-lock tab and a roll-lock tab receiver, as discussed with respect to FIG. 8. The roll-lock tab is positioned within the roll-lock tab receiver to secure attachment of the abutting joist segments, joist spacers, or box-frame segments.

FIG. 4 shows a side view 450 in which joist assembly is installed within box-frame interior 112 (without showing box-frame interior 112) and joist assembly 402 is being attached to joist assembly 300 and to box-frame interior 112. A roll-lock tab receiver of joist assembly 300 receives a roll-lock tab of joist assembly 402 and then joist assembly 402 is rolled down (e.g., rotated downward) so that the roll-lock tabs of the joist spacers of joist assembly 402 enter into the roll-lock tab receivers of box-frame interior 112. Other joist assemblies, such as joist assembly 404 can be similarly installed within box-frame interior 112.

Side 13 of box-frame 100 can be attached to the example structure discussed herein. In an alternative arrangement, box-frame 100 can include additional corner-post brackets 8 and an intermediate-post bracket on side 13. Posts 10 can include a post made of wood, aluminum, a composite material, or some other material. A wooden post can comprise pressure treated wood. The wood can be cedar, a hardwood, or some other wood. Posts 10 can be referred to as four-by-four posts. The four-by-four posts may not have a four inch width and four inch depth. A bottom portion of posts 10 can be placed upon concrete footers or upon brackets positioned on concrete footers within the ground below deck system 400. More than one intermediate-post bracket and respective post 10 can be used on any given side of an example deck system.

Figure 5:
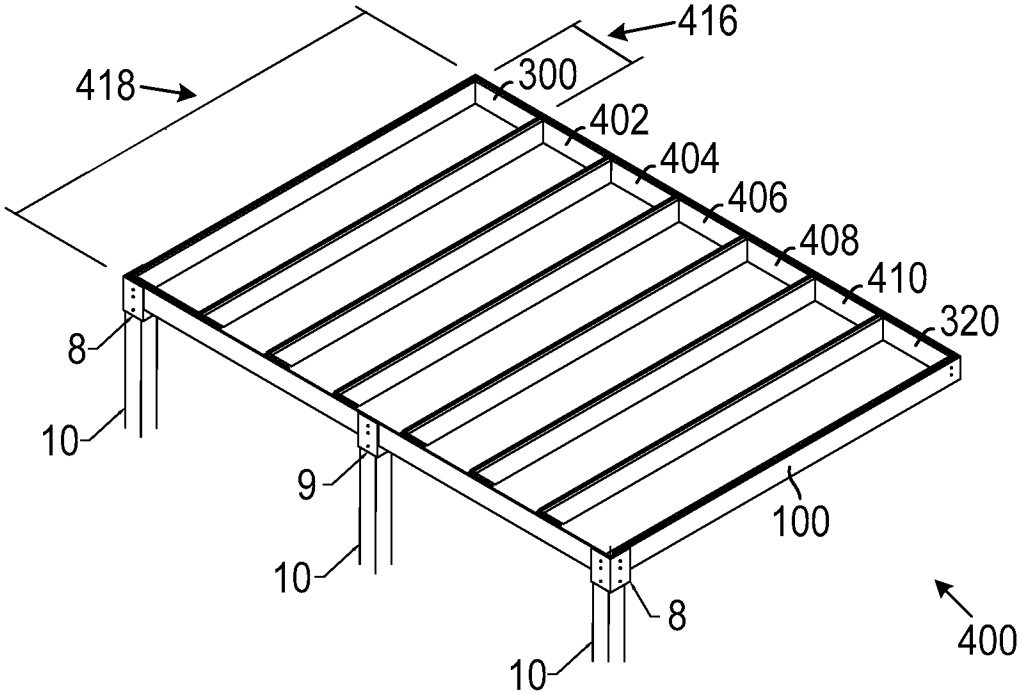
FIG. 5 shows details of the deck system shown in FIG. 4.

Next, FIG. 5 shows additional details regarding deck system 400. Joist assemblies 300, 402, 404, 406, 408, 410, and 320 are installed within box-frame 100. A person having ordinary skill in the art will understand that a different quantity of joist assemblies can be installed within box-frame. Corner-post brackets 8, intermediate-post bracket 9, and posts 10 of deck system 400 are described elsewhere herein.

FIG. 5 shows dimensions 416 and 418 to provide perspective of the example deck systems. Dimension 416 can represent any of a variety of lengths, such as a length between center lines of the longitudinal joists of joist assembly 300, a length between ends of joist segments of joist assembly 300, or a length of a joist spacer of joist assembly 300. As an example, dimension 416 can be 1'-2" (i.e., 14 inches), or some other number of inches. A dimension similar to dimension 416 can pertain to the other joist assemblies of deck system 400.

Dimension 418 can represent any of a variety of lengths, such as the lengths of the longitudinal joists within joist assemblies 300, 402, 404, 406, 408, 410, and 320 or a longitudinal length of each of those joist assemblies including the joist spacers. As an example, dimension 418 can be 6'-0" (i.e., 72 inches) or some other number of inches.

Figure 6:
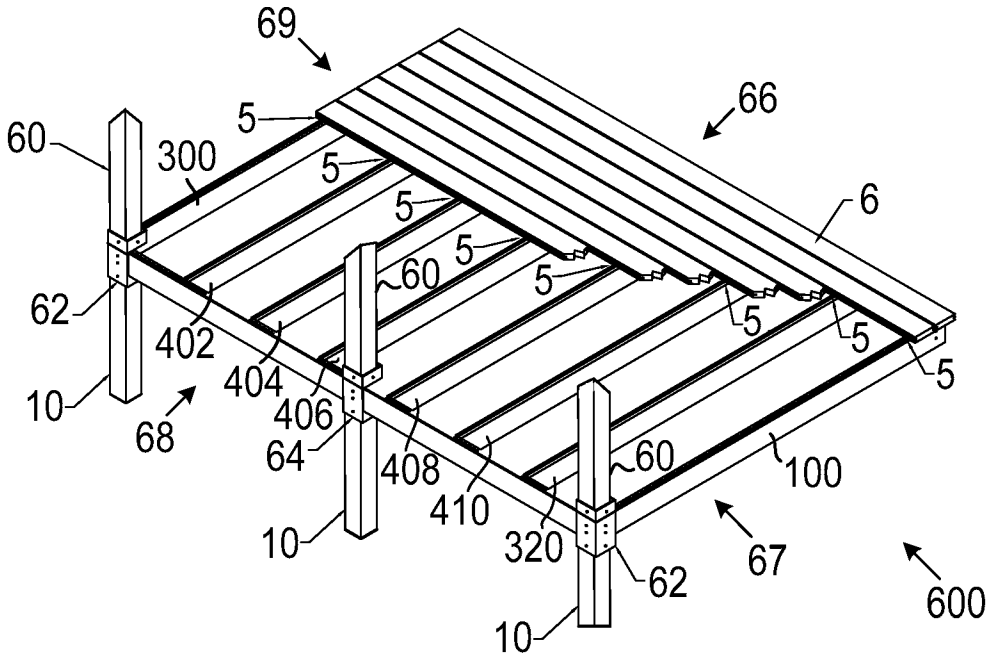
FIG. 6 shows another deck system in accordance with one or more example embodiments.

Next, FIG. 6 shows an example deck system 600. Deck system 600 includes box-frame 100 including joist assemblies 300, 402, 404, 406, 408, 410, and 320. Deck system 600 includes posts 10, railing posts 60, corner-post brackets 62, and intermediate-post bracket 64. Four sides 66, 67, 68, 69 of deck system 600 are identified in FIG. 6. Deck system 600 can include one or more additional intermediate-post brackets 9 or 62 along sides 66, 67, 68, or 69. Deck system 600 can include one or more additional corner-post brackets 8 or 64 at corners of box frame 100.

Deck system 600 includes a plurality of deck clips 5 and a plurality of deck boards 6. A separate deck clip 5 can be attached to each joist between each pair of adjacent deck boards 6. The deck clips 5 can establish a substantially common spacing between each adjacent pair of deck boards 6. The spacing between the deck boards 6 can allow for water to fall between the deck boards 6 to reduce ponding of the water on the deck boards 6. The substantially common spacing can, for example, be within a range of one sixteenth of an inch (i.e., 1/16") and one half inch (i.e., 1/2"), inclusive.

Deck boards 6 extend perpendicular to the longitudinal portion of the joist assemblies 300, 402, 404, 406, 408, 410, and 320. A single deck board 6 can extend completely across box-frame 100. Alternatively, two or more deck boards 6 can be used to extend across box-frame 100 instead of one of the single deck boards that extend across box-frame 100. A deck board 6 extending across box-frame 100 can include a portion (e.g., a one inch portion) that extends beyond box-frame 100. Deck boards 6 can comprise a deck board made of wood, aluminum, a composite material, or some other material. The wooden boards can comprise pressure treated wood, cedar, a hardwood, or some other wood.

Box-frame 100, at side 66, can be attached to the example structure discussed herein. In an alternative arrangement, box-frame 100 of can include additional corner-post brackets 62 and an intermediate-post bracket 64 on side 66. Posts 60, similar to posts 10, can include a post made of wood, aluminum, a composite material, or some other material. Posts 60, similar to posts 10, can be referred to as four-by-four posts.

Corner-post brackets 62 and intermediate-post bracket 64 include a portion extending above box-frame 100. Posts 60 can be inserted into those bracket portions and attached to corner-post brackets 62 and intermediate-post bracket 64 using any of a variety of fasteners. Horizontal railing components (not shown) can be attached to posts 60. The horizontal railing components can include an upper horizontal railing component and a lower horizontal railing component. A plurality of spindles or balusters can be attached to and between the horizontal railing components.

Figure 7:
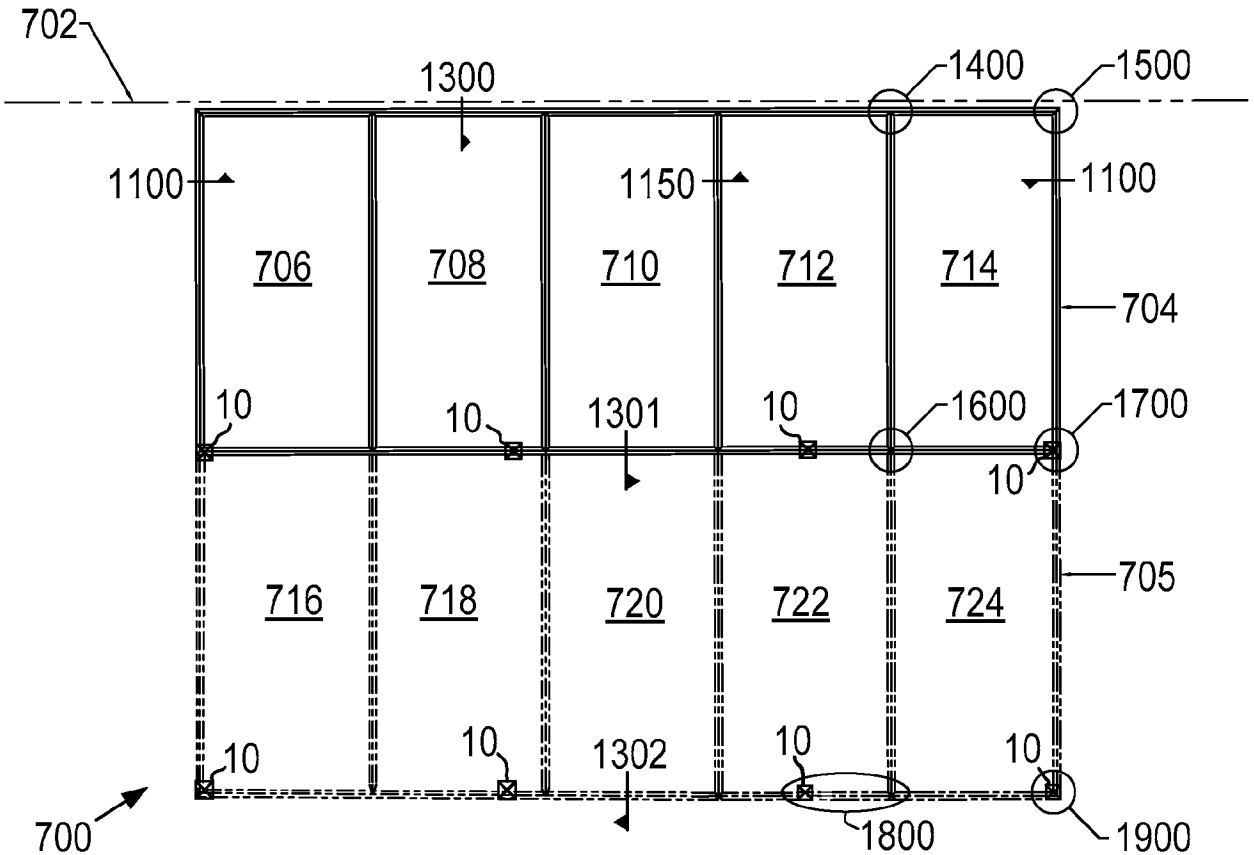
FIG. 7 shows another deck system in accordance with one or more example embodiments.

Next, FIG. 7 shows an example deck system 700 including deck systems 704 and 705. Deck system 704 is positioned adjacent to a structure 702. Structure 702 can be configured like the structures discussed herein. Deck system 704 is removably attachable to structure 702. For purposes of this description, removably attachable means a first element (such as deck system 704) can be attached to a second element (such as structure 702) and the first element can be unattached from and removed away from the second element. The attachment and un-attachment of the first and second elements can be repeated one or more times.

Deck system 704 includes joist assemblies 706, 708, 710, 712, and 714. One of joist assemblies 706 and 714 can be configured like joist assembly 320, while the other of those joist assemblies and joist assemblies 708, 710, and 712 can be configured like joist assembly 300.

Deck system 705 includes joist assemblies 716, 718, 720, 722, and 724. One of joist assemblies 716 and 724 can be configured like joist assembly 320, while the other of those joist assemblies and joist assemblies 718, 720, and 722 can be configured like joist assembly 300.

A number of posts 10 can be used to support deck system 700 above the ground. Each post 10 that supports deck system 700 can be positioned within a corner-post bracket (such as corner-post bracket 9 or 64) or within an intermediate-post bracket (such as intermediate-post bracket 8 or 62).

Figure 11:
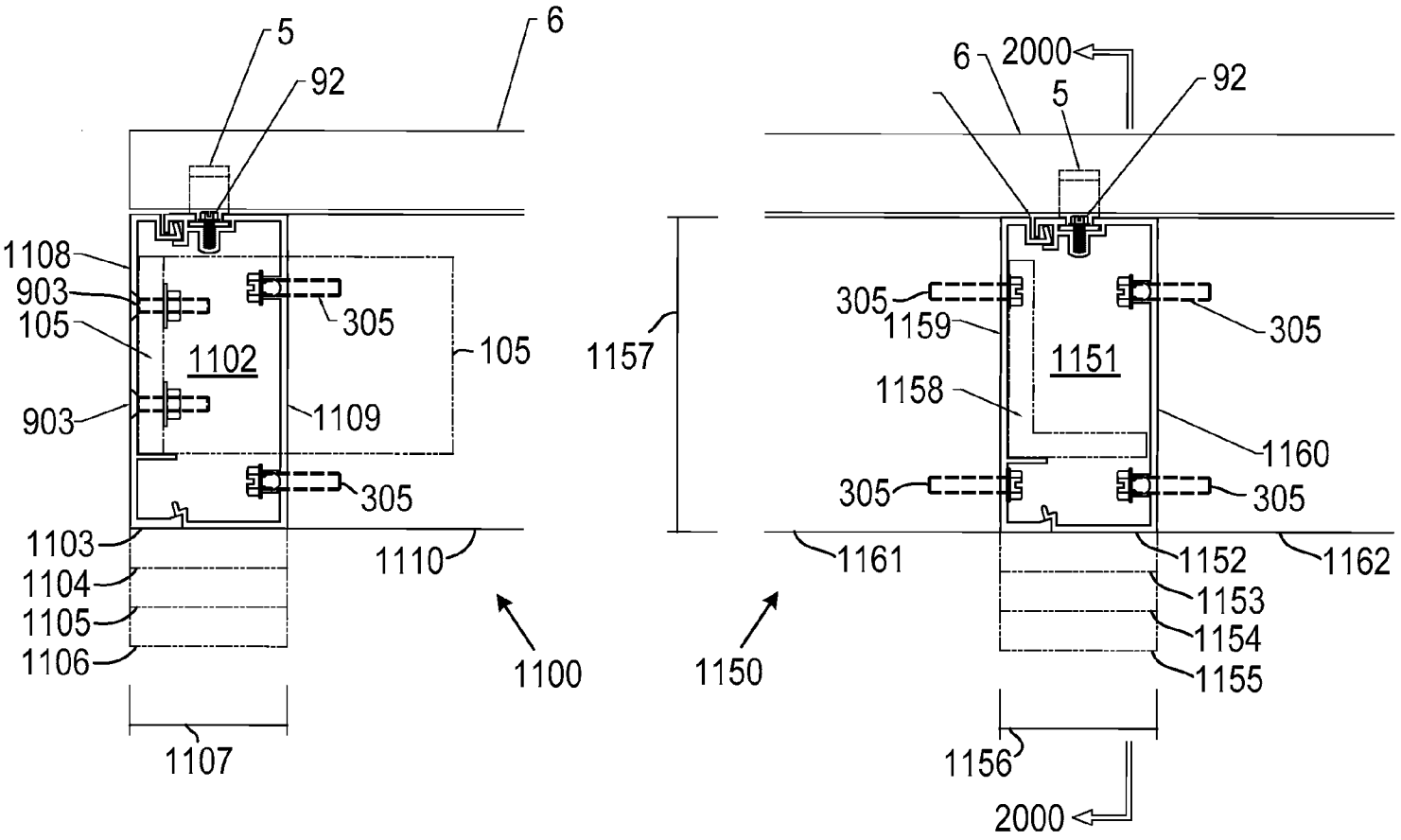
FIG. 11 shows partial section views shows in accordance with one or more example embodiments.
Figure 13:
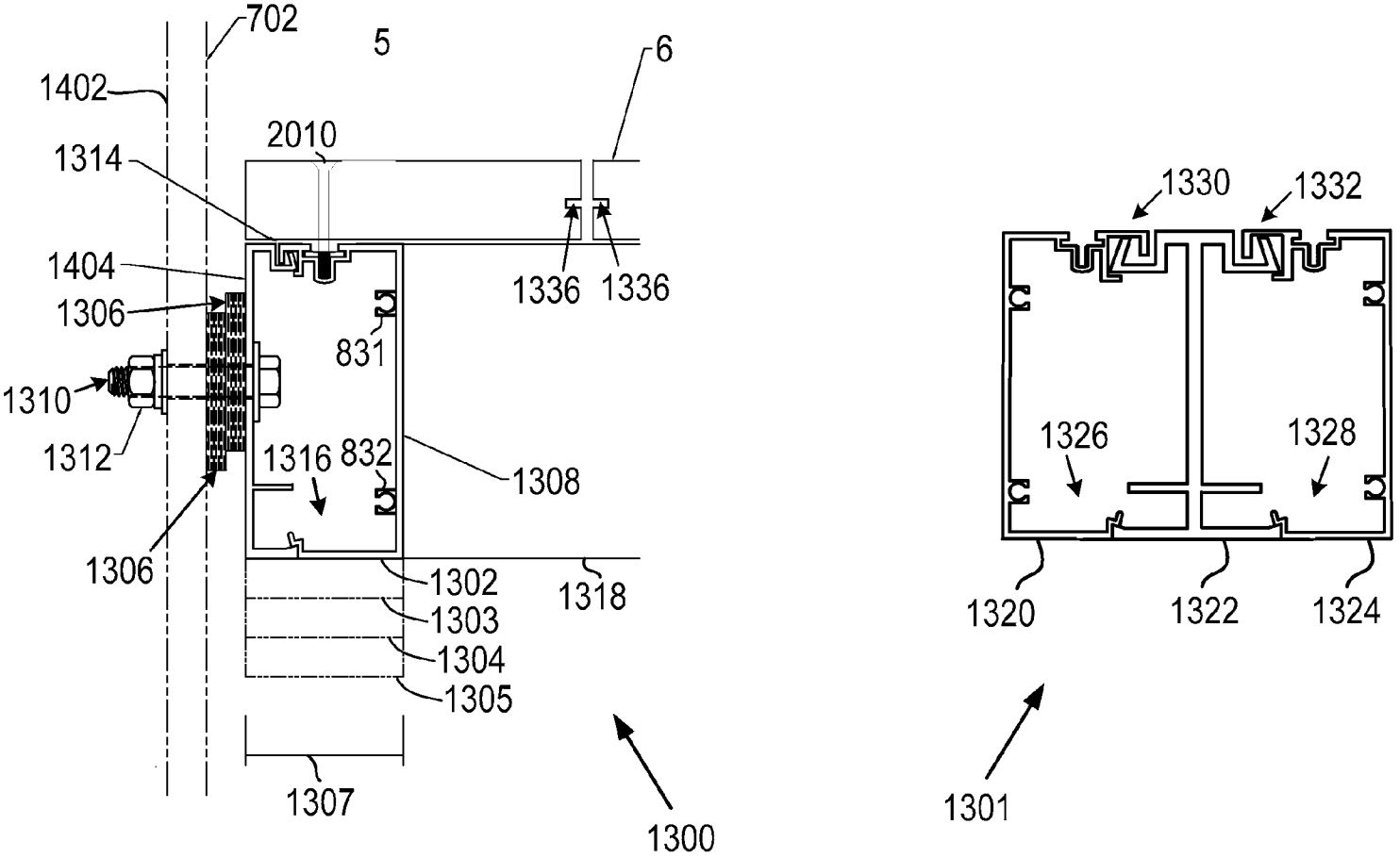
FIG. 13 shows a partial section view of a deck system in accordance with one or more example embodiments.

FIG. 7 shows example locations within deck system 700 at which partial section views 1100, 1150, 1300, 1301, and 1302, shown in FIG. 11 and FIG. 13 can be taken. A partial section view taken at line 1302 in FIG. 7 is not shown, but would look like section view 1300 in FIG. 7 without the following items: structure lines 702 and 1402, fasteners 1310 and 1312, and shims 1306. FIG. 7 also shows portions 1400, 1500, 1600, 1700, 1800 and 1900 at which large-scale views shown in FIGS. 14-19 pertain.

Next, FIG. 8 shows profiles of example extrusions 800 and 825 of various components of the example deck systems. Extrusion 800 includes vertical surfaces 801 and 802, horizontal surfaces 803, 804 and 806, a locking tab 805, an angle-clip shelf 110, an angle-clip slot 111, a roll-lock-tab receiver 809, and a roll-lock tab 810. Each of those elements of extrusion 800 can extend along an entire length of extrusion 800 or a component having a profile like extrusion 800.

Horizontal surface 804 is at a top side of extrusion 800. Horizontal surface 803 is at a bottom side of extrusion 800. Angle-clip shelf 110 or angle-clip slot 111 can be configured for guiding an angle-clip, such as angle-clip 105, within deck assembly components or extrusions having a profile like extrusion 800. An angle clip 105 can be positioned within angle-clip slot 111 or outside of and below angle-clip slot 111.

Extrusion 825 includes vertical surfaces 826 and 827, horizontal surfaces 828 and 829, 830, 833 and 838, long roll-lock tabs 834 and 840, screw splines (or self-tapping raceways) 831 and 832, a threaded screw slot 835, a roll-lock-tab receiver 836, a deck clip slot 837, a locking tab edge 841, and a locking tab retainer 839. Each of those elements of extrusion 825 can extend along an entire length of extrusion 825 or a component having a profile like extrusion 825.

Horizontal surfaces 829 and 830 are at a top side of extrusion 825. Horizontal surface 828 is at a bottom side of extrusion 825. Deck clips, such as deck clips 5, can be inserted into deck clip slot 837. A fastener placed through deck clip 5 and into threaded screw slot 835 can fasten deck clip 5 to extrusion 825 or a component having a profile like extrusion 825.

Next, FIG. 21 shows profiles of example extrusions 850 and 875 used for various components of the example deck systems. Extrusion 850 comprises the same elements as extrusion 825 except that extrusion 850 includes short roll-lock tab 843 instead of long roll-lock tab 834. Extrusions 825 and 850 can be formed from separate and different extrusion dies. Alternatively, extrusion 850 can be formed by milling extrusion 825 to modify long roll-lock tab 834 to be a short roll-lock tab 843. As an example, long roll-lock tabs 834 or 840 can be or about twice as long (i.e., 2×), three times as long (i.e., 3×), four times as long (i.e., 4×) or five times as long (i.e., 5×) as short roll-lock tab 843. As another example, long roll-lock tabs 834 or 840 can be within a range of 1.1 (i.e., 1.1×) to 5 times (i.e., 35×) longer than short roll-lock tab 843. As yet another example, short roll-lock tab 843 can be ⅛ inches long and long roll-lock tabs 834 or 840 can be ⅜ to ½ inches long. The length of short roll-lock tab 843 can be a length that allows a joist assembly including a joist spacer or segment having a profile like extrusion 850 to be snapped into an end of a box-frame assembly and secured within the box-frame assembly, yet allow for subsequent removal of that joist assembly from the box-frame assembly.

Extrusion 875 includes horizontal surfaces 876 and 879, vertical surfaces 877 and 878 of a vertical riser 891 extending between horizontal surfaces 876 and 879, angle clip shelves 886 and 887, angle clip slots 884 and 885, locking tabs 888 and 889, roll-lock tab receivers 880 and 881, and roll-lock tabs 882 and 883. Each of those elements of extrusion 875 can extend along an entire length of extrusion 875 or a component having a profile like extrusion 875. Horizontal surface 879 is at a top of extrusion 875. Horizontal surface 876 is at a bottom of extrusion 875.

Figure 23:
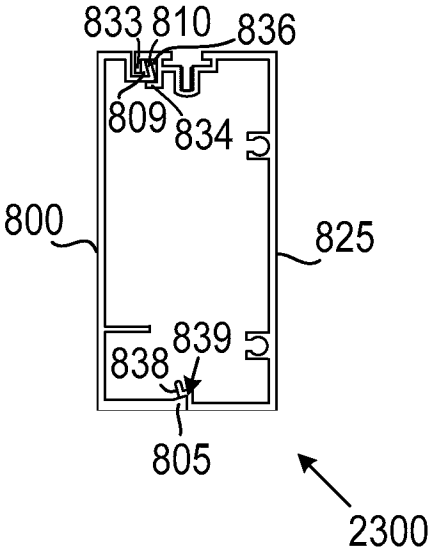
FIG. 23 shows a profile of two extrusions connected together.

Next, FIG. 23 shows a profile 2300 of extrusions 800 and 825 connected to one another. Connecting extrusions 800 and 825 to one another can include bringing locking tab 805 into contact with locking tab retainer 839, and then rotating one or more of the extrusions until roll-lock tab 810 is positioned within roll-lock-tab receiver 836 and roll-lock tab 833 is positioned within roll-lock-tab receiver 809. Long toll-lock tab 834 can provide for a more secured connection of the extrusions 800 and 825. Alternatively, roll-lock tab 810 can be positioned within roll-lock-tab receiver 836 and roll-lock tab 833 can be positioned within roll-lock-tab receiver 809 and then one or more of the extrusions can be rotated until locking tab 805 contact and attaches to locking tab retainer 839.

Figure 9:
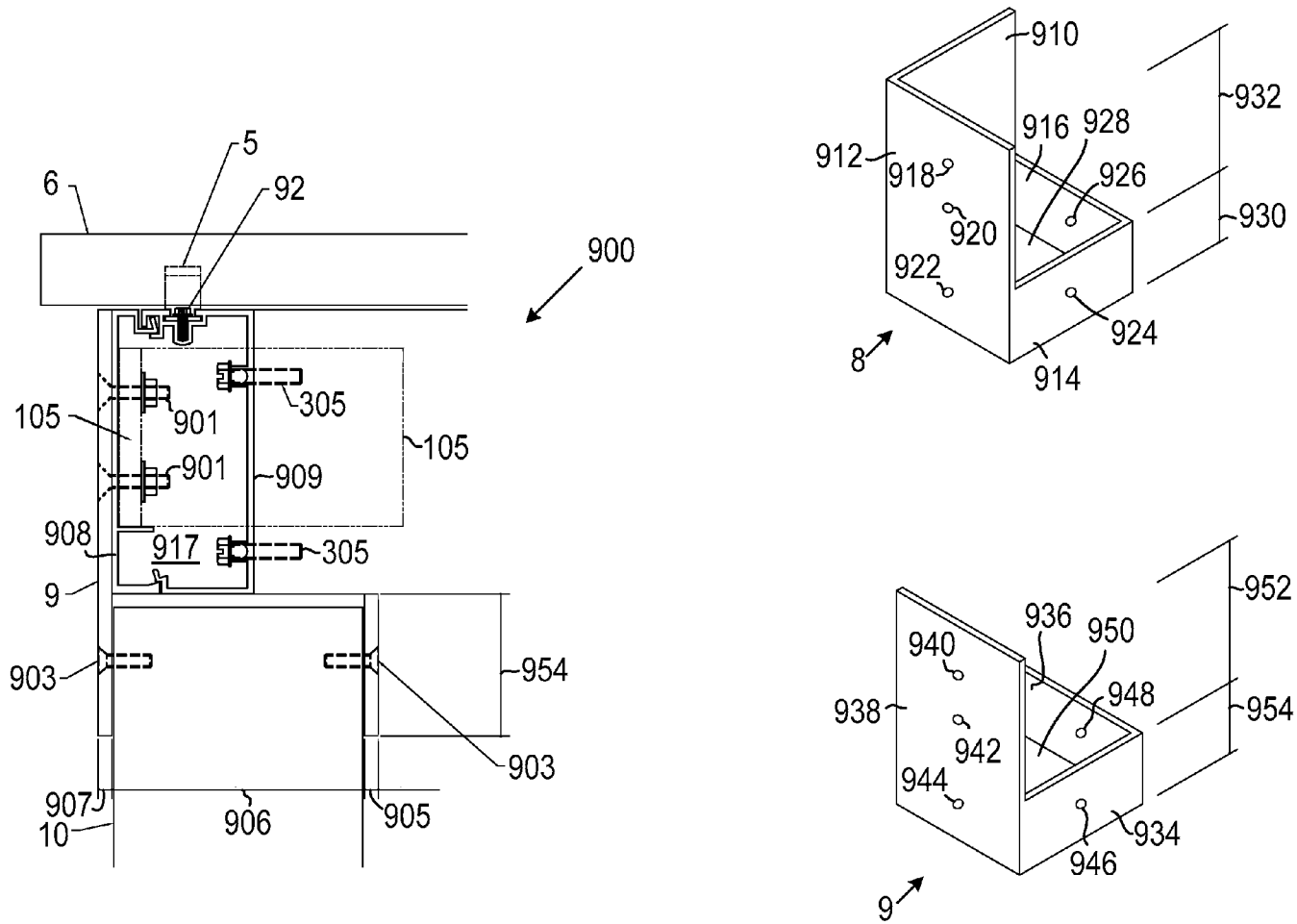
FIG. 9 shows a partial section view of a deck system and shows brackets in accordance with one or more example embodiments.

Next, FIG. 9 shows a partial section view 900 of a portion of a box-frame assembly attached to a post 10, and a deck board 6 attached to the box-frame assembly using deck clip 5 and a deck clip screw 92. Deck screws 92, if used, can comprise No. 10 sheet metal screws with a Phillips head, a 24 threads per inch rating, and are 0.75 inches long, Other examples of screws 92 are also possible. The box-frame assembly can be configured like box-frame assembly 100.

Section view 900 shows post 10 positioned within and attached to intermediate-post bracket 9 using fasteners 903. Fasteners 903 can comprise a flat-head fastener, such as a flat-head screw. Dimensions 905, 906, and 907 are provided to provide perspective with respect to intermediate-post bracket 9. Dimensions 905 and 907 can represent a thickness of walls and dimension 906 can represent a length of an opening within intermediate-post bracket 9. As an example, dimensions 905 and 907 can be three sixteenths of an inch (i.e., 3/16") or some other number of inches. As another example, dimension 906 can be three and nine sixteenths inches (i.e., 3 9/16") or some other number of inches.

FIG. 9 shows a joist or box-frame segment 917 comprising an extrusion 908 configured like extrusion 800 and an extrusion 909 configured like extrusion 825. Extrusions 908 and 909 can attach to together similar to the manner in which extrusions 800 and 825 are attached as described with respect to FIG. 23. FIG. 9 shows an angle clip 105 attached to extrusion 908 using fasteners 901. Fasteners 901 can comprise number 10 by 1 inch (i.e., #10×1") flat head screws with a lock washer and nut. FIG. 9 shows fasteners 305 within screw splines, such as screw splines 831 and 832 shown in FIG. 8. Fasteners 305 can be positioned within screw splines of one or more extrusions, such as the extrusions of a joist spacer and into a joist segment.

FIG. 9 shows details of intermediate-post bracket 9, which is shown in several other figures as well. Intermediate-post bracket 9 comprises long side 938, short sides 934 and 936, another short side (not shown) opposite short side 934 and between long side 938 and short side 936, and a post-opening 950. Long side 938 includes attachment holes 940, 942, 944. Short side 934 includes attachment hole 946. Short side 936 includes attachment hole 948. The short side opposite short side 934 can include an attachment hole at a position similar to attachment hole 946. Short sides 934 and 936 can have a height dimension 954 of 2 inches or some other number of inches. Long side 938 can have a height dimension 952 of 4 inches or some other number of inches above the upper surface of short sides 934, 936.

A portion of a post, such as post 10, can be inserted into post-opening 950. Fasteners, such as fasteners 903, can be inserted into holes 944, 946, and 948 and an attachment hole on short side opposite short side 934 to secure corner-post bracket 9 to post 10. A box-frame segment, such as box-frame segment 102, positioned above post-opening 950 can be attached to corner-post bracket 9 using fasteners, such as fasteners 901, placed into attachment holes 940 and 942.

FIG. 9 also shows details of corner-post bracket 8, which is shown in several other figures described herein. Corner-post bracket 8 comprises long sides 910 and 912, short sides 914 and 916, a post-opening 928, attachment holes 918, 920 and 922 on long side 912, attachment hole 924 on short side 914, and attachment hole 926 on short side 916. Long side 910 can include attachment holes in arrangement similar to the attachment holes on long side 912. Short sides 914 and 916 can have a height dimension 930 of 2 inches or some other number of inches. Long sides 910 and 912 can have a height dimension 932 of 4 inches or some other number of inches above the upper surface of short sides 914 and 916.

A portion of a post, such as post 10, can be inserted into post-opening 928. Fasteners, such as fasteners 903, can be inserted into attachment holes 922, 924 and 926 and an attachment hole on long side 910 to secure corner-post bracket 8 to post 10. Two box-frame segments, such as box-frame segments 101 and 102, positioned above post-opening 928 can be attached to corner-post bracket 8 using fasteners, such as fasteners 901, placed into attachment holes 918 and 920 or similarly positioned attachment holes within long side 910.

Figure 10:
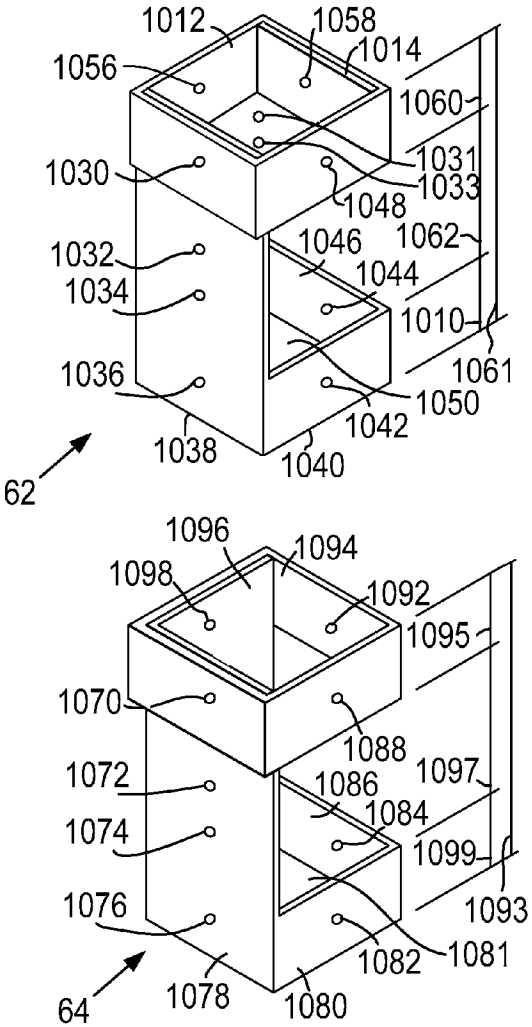
FIG. 10 shows a partial section view of a deck system and shows brackets in accordance with example embodiment(s)
Figure 10:
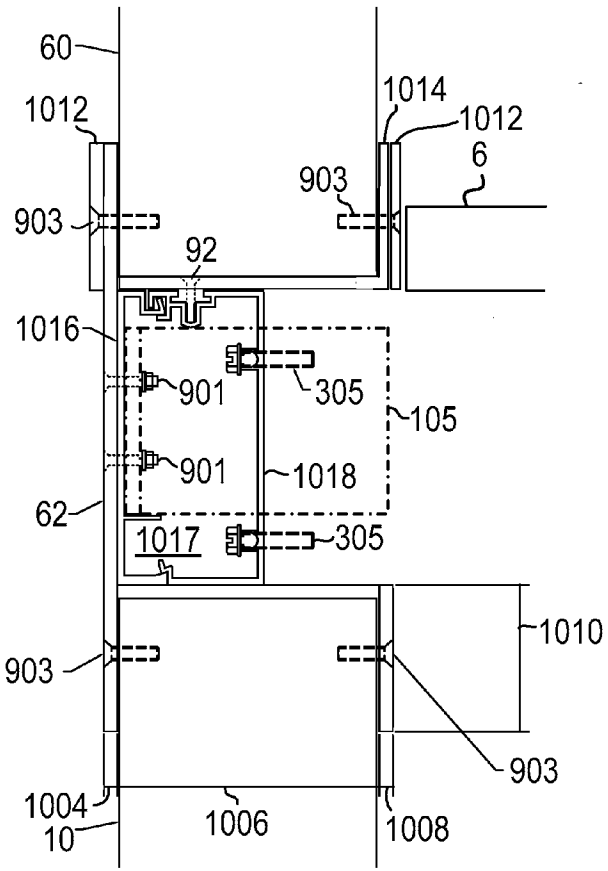

Next, FIG. 10 shows a partial section view 1000 of a portion of a box-frame assembly attached to a post 10 and a deck board 6. The box-frame assembly can be configured like box-frame 100.

Section view 1000 shows post 10 positioned within and attached to intermediate-post bracket 62 using fasteners 903. Dimensions 1004, 1006, 1008, and 1010 are provided to provide perspective with respect to intermediate-post bracket 62. Dimensions 1004 and 1008 can represent a thickness of walls and dimension 1006 can represent a length of an opening within intermediate-post bracket 62. Dimension 1010 can represent a length (e.g., a height) of a short wall of intermediate-post bracket 62. Dimensions 1004 and 1008 can be three sixteenths of an inch (i.e., 3/16") or some other number of inches. Dimension 1006 can be three and nine sixteenths inches (i.e., 3 9/16") or some other number of inches. Dimension 1010 can be two inches (i.e., 2") or some other number of inches.

FIG. 10 shows a joist or box-frame segment 1017 comprising an extrusion 1016 configured like extrusion 800 and an extrusion 1018 configured like extrusion 825. Extrusions 1016 and 1018 can attach to together similar to the manner in which extrusions 800 and 825 are attached as described with respect to FIG. 23. FIG. 10 shows fasteners 305 within screw splines, such as screw splines 831 and 832 of a joist spacer and into a joist segment.

Intermediate-post bracket 62 includes a portion that abuts joist or box-frame segment 1017 and a portion above joist or box-frame segment 1017. A post 60 can be positioned within support ring 1012 and above a support bracket 1014 attached to box-frame segment 1017 using one or more deck screws 92. Support ring 1012 can include attachment holes 1030, 1048, 1056, and 1058. Support ring 1012 and support bracket 1014 can be made of aluminum or another material. Support bracket 1014 can be configured as an L-bracket that includes attachment holes 1031 and 1033. One or more fasteners 903 can attach intermediate-post bracket 62 and support ring 1012 to post 60. One or more fasteners 903 can attach support ring 1012 and support bracket 1014 to post 60.

FIG. 10 shows details of intermediate-post bracket 62, which is shown in several other figures as well. Intermediate-post bracket 62 comprises a long side 1038, short sides 1040 and 1046, another short side (not shown) opposite short side 1040 and between long side 1038 and short side 1046, and a post-opening 1050. Long side 1038 includes attachment holes 1032, 1034, and 1036, and another attachment hole in line with attachment hole 1030 of support ring 1012. Short side 1040 includes attachment hole 1042. Short side 1046 includes attachment hole 1044. The short side opposite short side 1040 can include an attachment hole at a position similar to attachment hole 1042. Short sides 1040 and 1046 can have a height dimension 1010, as previously discussed. Long side 1038 can have a height dimension 1061 equal to eight inches or some other number of inches. Support ring 1012 can have a height dimension 1060 equal to two inches or some other number of inches. Dimension 1062 can represent a space between short side 1040 and support ring 1014. Dimension 1062 can equal four inches or some other number of inches.

A portion of a post, such as post 10, can be inserted into post-opening 1050. Fasteners, such as fasteners 903, can be inserted into holes 1036, 1042, 1044, and an attachment hole on short side opposite short side 1040 to secure intermediate-post bracket 62 to post 10. A joist or box-frame segment 1017, positioned above post-opening 1050 can be attached to intermediate-post bracket 62 using fasteners, such as fasteners 901, placed into attachment holes 1032 and 1034.

FIG. 10 also shows details of corner-post bracket 64, which is shown in several other figures described herein. Corner-post bracket 64 comprises long sides 1078 and 1096, short sides 1080 and 1086, and a post-opening 1081. Long side 1078 includes attachment holes 1072, 1074, and 1076, and another attachment hole in line with attachment hole 1070 of support ring 1094. Short side 1080 includes an attachment hole 1082. Short side 1086 includes an attachment hole 1084. Long side 1096 can include attachment hole 1098 and other attachment holes arranged like the attachment holes on long side 1078. Short sides 1080 and 1086 can have a height dimension 1099 equal to two or some other number of inches. Long sides 1078 and 1096 can have a height dimension 1093 of eight or some other number of inches. Support ring 1094 can have a height dimension 1095 equal to two or some other number of inches. Dimension 1097 can represent a space between short side 1080 and support ring 1094. Dimension 1097 can equal four or some other number of inches.

A portion of a post 10 can be positioned within post-opening 1081. Fasteners, such as fasteners 903, can be inserted into attachment holes 1076, 1082, 1084, and an attachment hole on long side 1096 to secure corner-post bracket 62 to post 10. A joist or box-frame segment 1017, positioned above post-opening 1081 and below support ring 1096, can be attached to corner-post bracket 62 using fasteners 903 placed into attachment holes 1072, 1074 and similarly positioned holes on long side 1096.

Intermediate-post bracket 64 includes a portion that abuts joist or box-frame segment 1017 and a portion above joist or box-frame segment 1017. A post 60 can be positioned within support ring 1092. Support ring 1092 can include attachment holes 1070, 1088, 1092, and an attachment hole in line with attachment hole 1096. Support ring 1092 can be made of aluminum or another material. One or more fasteners 903 can attach intermediate-post bracket 62 and support ring 1092 to post 60.

Next, FIG. 11 shows a partial section view 1100 through various portions of deck system 704 shown in FIG. 7. Section view 1100 shows a perimeter joist 1102 of deck system 704 having a lower surface 1103 and alternative lower surfaces 1104, 1105, and 1106 such that perimeter joist 1102 can be formed with extrusions of different heights. Extrusions having longer heights can be used for longer spans of perimeter joist 1102.

Perimeter joist 1102 can be formed by attaching an extrusion 1108 to an extrusion 1109. Extrusion 1108 can be configured like extrusion 800. Extrusion 1108 can be a box-frame segment of box-frame 100. Extrusion 1108 can be configured like extrusion 825 or 850. Extrusion 1108 can be a joist segment of a joist assembly, such as joist assembly 300 or 320. A deck board 6 is attached to perimeter joist 1102 using deck clip 5 and a deck clip screw 92. That deck board, deck clip, and deck clip screw are not shown in FIG. 7.

An angle clip 105 attaches to perimeter joist 1102 and to a joist spacer 1110 of the box-frame of deck system 704. Fasteners 903 can fasten angle clip 105 to perimeter joist 1102. In FIG. 11, fasteners 305 can be positioned within screw splines, such as screw splines 831 and 832 described with respect to FIG. 8. Fasteners 305 can be positioned within screw splines of one or more extrusions, such as the extrusions of a joist segment and into a joist spacer.

Dimension 1157 pertains to section view 1100 and to another section view 1150 shown in FIG. 11. Dimension 1157 represents a height of perimeter joist 1102. Dimension 1157 can equal four or another number of inches. Dimension 1107 represents an example width of perimeter joist 1102. Dimension 1107 can equal 1.75 (i.e., 1¾) inches or another number of inches.

Section view 1150 is another partial section view through deck system 704 shown in FIG. 7. Section view 1150 shows details of a multi joist segment 1151 formed by joist segments 1159 and 1160. Joist segment 1159 is configured like extrusion 800 and is part of joist assembly 710. Joist segment 1160 is configured like extrusion 825 and is part of joist assembly 712. Section view 1150 shows a lower surface 1152 of multi joist segment 1151 and alternative lower surfaces 1153, 1154, and 1155 of multi joist segment 1151. Extrusions having longer heights can be used for longer spans of multi joist segment 1151.

A deck board 6 is attached to multi joist segment 1151 using deck clip 5 and a deck clip screw 92. That deck board, deck clip, and deck clip screw are not shown in FIG. 7. Multi joist segment 1151 is attached to joist spacers 1161 and 1162 of respective joist assemblies. Dimension 1156 represents an example width of multi joist segment 1151. Dimension 1156 can equal 1.75 (i.e., 1¾) inches or another number of inches. A reinforcing angle 1158 can be used within multi joist segment 1151.

Figure 12:
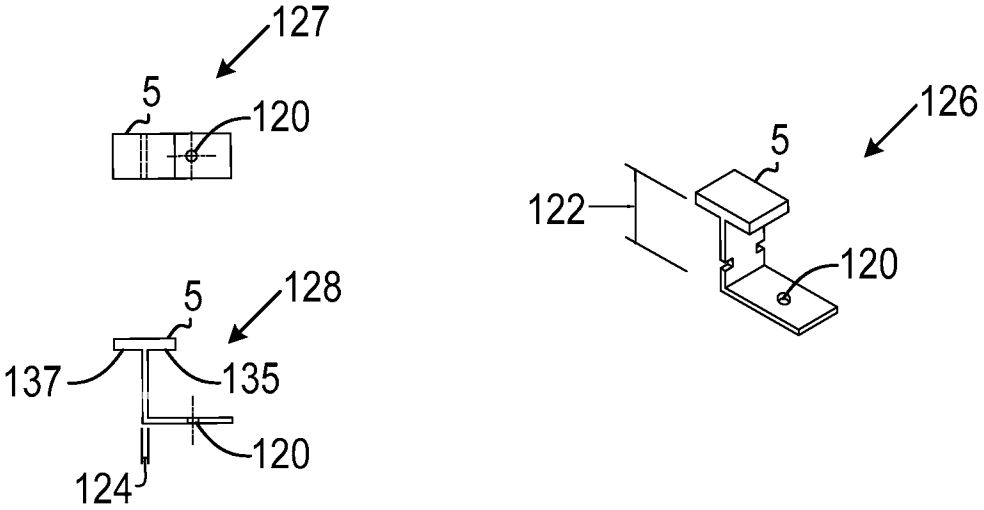
FIG. 12 shows various views of a deck clip in accordance with one or more example embodiments.

Next, FIG. 12 shows an example deck clip 5. FIG. 12 includes an isometric view 126 of deck clip 5, a top view 127 of deck clip 5, and a side view 128 of deck clip 5. Deck clip 5 includes deck board retaining surfaces 135 and 137 to retain deck boards to the joist assemblies. Deck clip 5 can include a through-hole 120 for insertion of a deck clip screw 92. Deck clip 5 can be made of stainless steel, aluminum, or some other material. Dimensions 122, 124 can be any of a variety of dimensions. Dimension 122 can depend upon a height (e.g., depth) of deck boards 6, or a height of a deck clip slot positioned along a side of a deck board 6, used within a deck system. As an example, dimension 122 can equal ⅝ inches or some other dimension. As an example, dimension 124, a thickness of deck clip 5, can equal 1/16 inches or some other dimension. The size of the deck clips, such as the depth and thickness dimensions, can vary per requirements of the deck boards installed onto the deck system.

Next, FIG. 13 a partial section view 1300 through a portion of deck system 704 and a portion of joist assembly 708 shown in FIG. 7. FIG. 13 shows joist spacer 1308 and a joist segment 1318 of joist assembly 708, and box-frame segment 1404 of box-frame 100 of deck system 704. Box-frame segment 1404 is configured like extrusion 800. Joist spacer 1308 is configured like extrusion 850. Joist segment 1318 can be configured like extrusion 800, 825, or 850.

Joist spacer 1308 and box-frame segment 1404 can attach securely together at attachment point 1316 using the locking tab of box-frame segment 1404 and the locking tab retainer of joist spacer 1308, and using the roll-lock tab and roll-lock tab receivers of box-frame segment 1404 and joist spacer 1308. Fasteners 902 can attach joist spacer 1308 to joist segment 1318.

FIG. 13 shows box-frame segment 1404 is attached to structure 702 using fasteners 1310 and 1312. Fastener 1310 can comprise a lag screw used without fastener 1312. Shims 1306 are positioned between box-frame segment 1404 and the external line of structure 702. Shims 1306 can include through-holes to allow fastener 1310 to pass through shims 1306. Alternatively shims 1306 can be positioned adjacent to fastener 1310. Fastener 1312 can include a nut that abuts an internal line 1402 representing, for example, a wall of structure 702.

FIG. 13 shows a deck clip 5 and a deck clip screw 92 positioned within joist spacer 1308. FIG. 13 shows a deck board 6 attachable to deck system 700, and the attached box-frame segment 1404 and joist spacer 1308 having a lower surface 1302 or alternative lower surfaces 1303, 1304, and 1305. The alternative lower surfaces provide for longer spans of box-frame segment 1404 and joist spacer 1308 or for increased loading of deck system 700. Dimension 1307 represents an example width of the attached box-frame segment 1404 and joist spacer 1308. Dimension 1307 can equal two inches or another dimension.

FIG. 13 also shows a partial section view 1301 for a portion of deck systems 704 and 705 shown in FIG. 7. The partial section view 1301 shows joist spacers 1320 and 1324, configured like extrusion 800, and box-frame segment 1322, configured like extrusion 875. Box-frame segment 104 of box-frame 100 can comprise box-frame segment 1322. Joist spacer 1320 can be a joist spacer of joist assembly 710. Joist spacer 1324 can be a joist spacer of joist assembly 720. Partial section view 1301 shows attachment points 1326 and 1328 of the locking tabs of box-frame segment 1322 to the locking tab retainers of joist spacers 1320 and 1324. Partial section view 1301 also shows retaining points 1330 and 1332 of roll-lock tabs of joist spacers 1320 and 1324 within roll-lock tab receivers of box-frame segment 1322.

Figure 14:
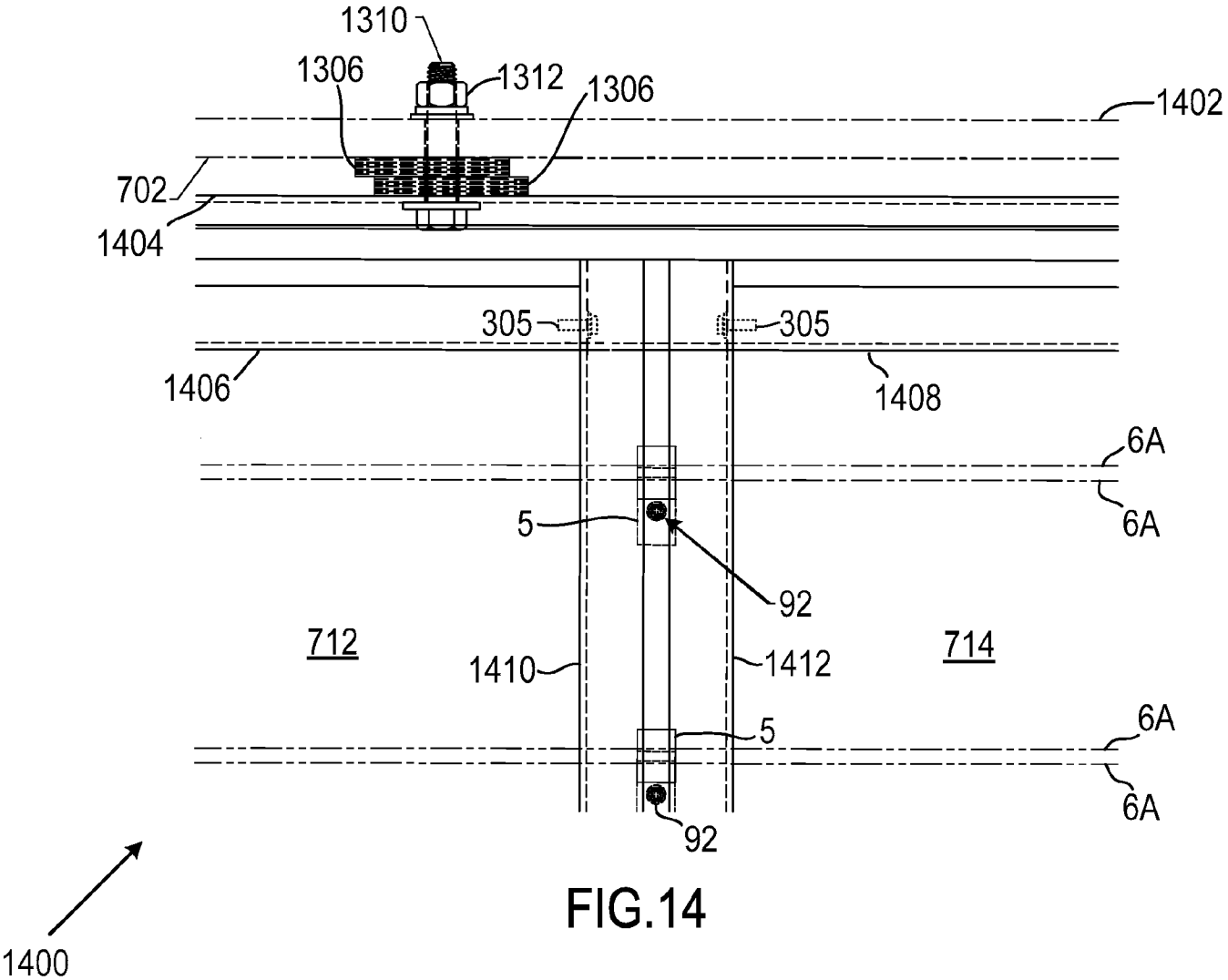
FIGS. 14, 15, 16, 17, 18, and 19 are large-scale views of portions of a deck system shown in FIG. 7.

Next, FIG. 14 is a large-scale plan view of a portion 1400 of deck system 700 shown in FIG. 7. FIG. 14 shows that portion of deck system 700 attached to structure 702 using fasteners 1310 and 1312. Shims 1306 are positioned between a box-frame segment 1404 and an external line of structure 702. Fasteners 1310 and 1312 and shims 1306 can be positioned in other positions of structure 702 and box-frame segment 1404. For example, fastener 1310 can be positioned such that a center line running length-wise of fastener 1310 is coaxially with an interface point at which joist segments 1410 and 1412 abut one another, or at another position.

A box-frame segment 1404 can be configured like extrusion 800 and can be attached to a joist spacer 1406 of joist assembly 712, and to a joist spacer 1408 of joist assembly 714. Extrusions 1406 and 1408 can be configured like extrusion 850. Joist assembly 712 includes a joist segment 1410 configured like extrusion 800. Joist assembly 714 includes a joist segment 1412 configured like extrusion 825. Joist spacer 1406 and joist segment 1410 attach to one another using one or more fasteners 902 installed into screw splines of joist segment 1410. Joist spacer 1408 and joist segment 1412 attach to one another using one or more fasteners 902 installed into screw splines of joist segment 1412.

FIG. 14 shows deck clips 5 and deck clip screws 92 positioned within extrusion 1412. FIG. 14 also shows positions of edges 6A of deck boards 6 attachable to deck system 700.

Figure 15:
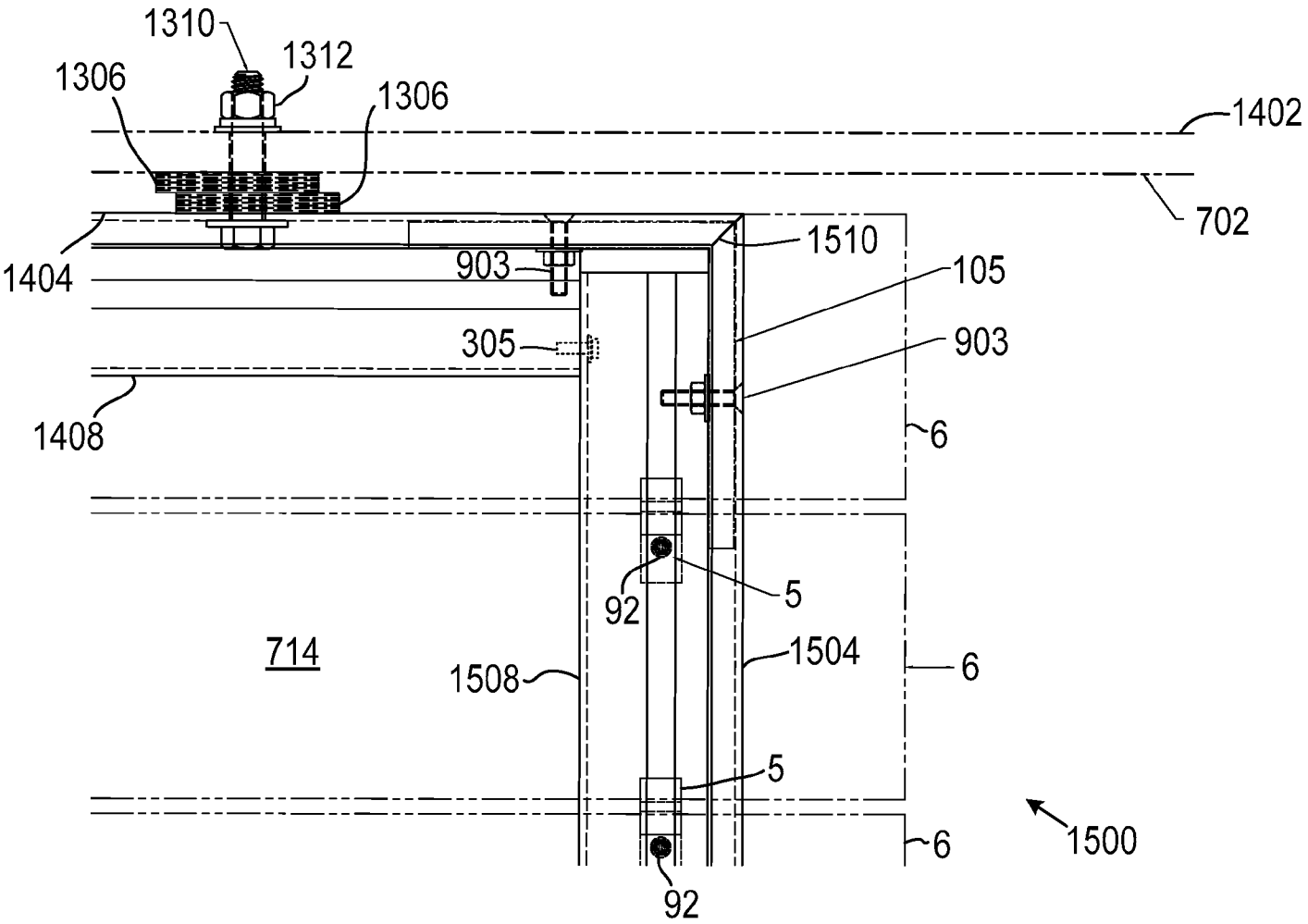

Next, FIG. 15 is a large-scale plan view of a portion 1500 of deck system 700 shown in FIG. 7. FIG. 15 shows that portion of deck system 700 attached to structure 702 using fasteners 1310 and 1312. Shims 1306 are positioned between a box-frame segment 1404 of box-frame 100 of deck system 700 and an external line of structure 702. Shims 1306 can include through-holes to allow fastener 1310 to pass through shims 1306. Alternatively shims 1306 can be positioned adjacent to fastener 1310. Fastener 1312 can abut internal line 1402 of structure 702.

Box-frame segment 1404 can be configured like extrusion 800 and can be attached to a joist spacer 1408 of joist assembly 714. Portions of abox-frame segments that abut one another can be mitered as shown at miter joint 1510. Joist spacer 1408 can be configured like extrusion 850. Joist assembly 714 includes a joist segment 1508 configured like extrusion 825 or 850. The box-frame of deck system 700 includes a box-frame segment 1504 configured like extrusion 800. Box-frame segments 1404 and 1504 can attach to one another using angle clip 105, and angle clip 105 can attach to box-frame segments 1404 and 1504 using one or more fasteners 903 installed into screw splines of box-frame segments 1404 and 1504. Deck clips 5 and deck clip screws 92 can be positioned within joist segment 1508. Joist spacer 1408 and joist segment 1508 can be attached together using one or more fasteners 305. FIG. 15 also shows positions of deck boards 6 attachable to deck system 700.

Figure 16:
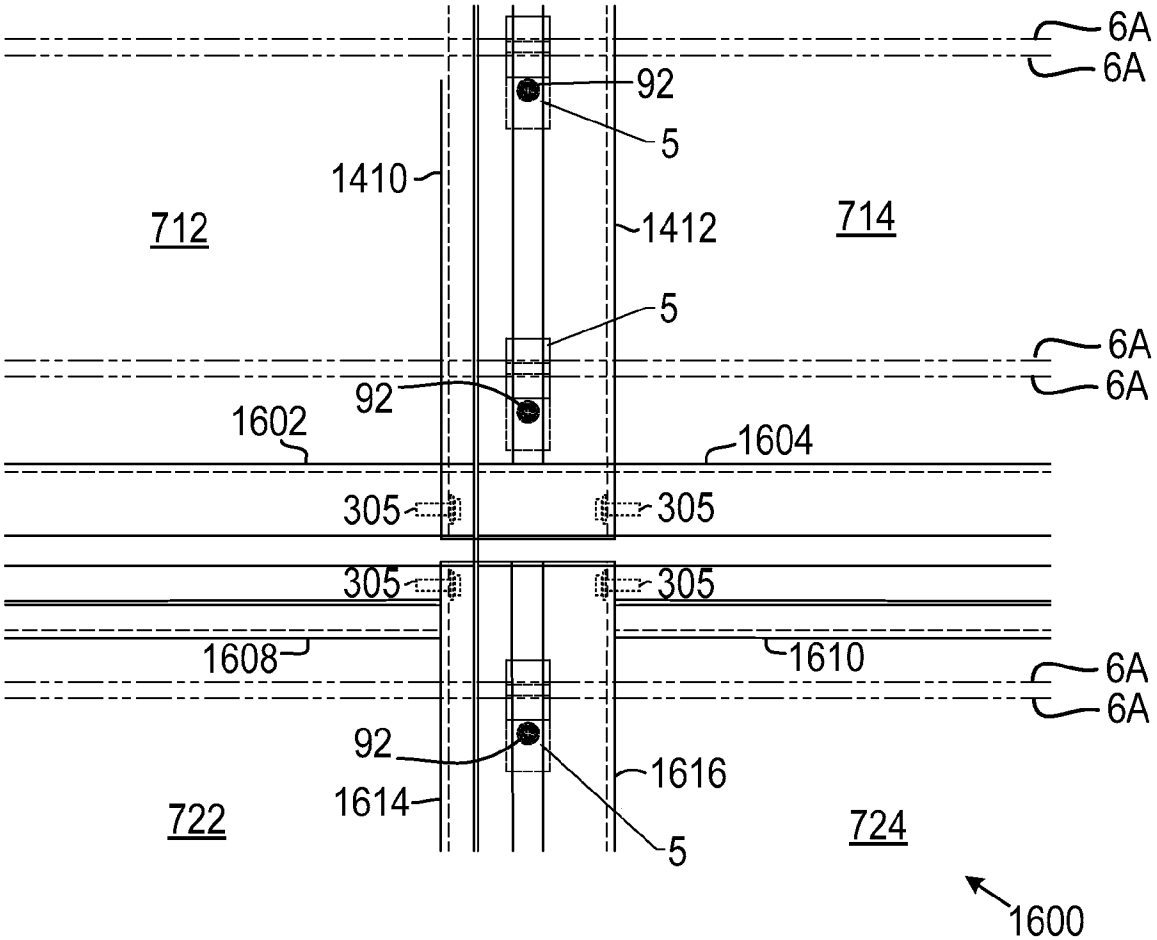

Next, FIG. 16 is a large-scale view of a portion 1600 of deck system 700 shown in FIG. 7. Portion 1600 includes extrusions of joist assemblies 712, 714, 722, and 724 shown in FIG. 7.

Joist assembly 712 includes joist segment 1410, and a joist spacer 1602 configured like extrusion 850. Joist segments 1410 and 1602 can attach to one another using one or more fasteners 902.

Joist assembly 714 includes a joist spacer 1604 configured like extrusion 850 and joist segment 1412. Extrusions 1604 and 1412 can attach to one another using one or more fasteners 902. Joist assembly 714 can be the last joist assembly installed into deck system 700 during assembly and the first joist assembly removed from deck system 700 during disassembly of deck system 700.

Joist assembly 722 includes a joist spacer 1608 configured like extrusion 850, and a joist segment 1614 configured like extrusion 800. Joist spacer 1608 and joist segment 1614 can attach to one another using one or more fasteners 902.

Joist assembly 724 includes a joist spacer 1610 configured like extrusion 850, and a joist segment 1616 configured like extrusion 850. Joist spacer 1610 and joist segment 1616 can attach to one another using one or more fasteners 902. Joist assembly 724 can be the last joist assembly installed into deck system 705 during assembly and the first joist assembly removed from deck system 705 during disassembly of deck system 705.

In accordance with an example embodiment, roll-lock tabs of joist spacers 1602 and 1604 can be positioned within a roll-lock tab receiver of a box-frame segment of deck system 700, and roll-lock tabs of joist spacers 1608 and 1610 can be positioned within a roll-lock tab receiver of a box-frame segment of deck system 705. Each of those box-frame segments can be configured like extrusion 800 and can be attached to one another using fasteners 902 or another type of fastener. The locking tabs of the box-frame segments and the locking tab retainers of joist spacers 1602, 1604, 1608, and 1610 are used for attachment of those joist spacers to the box-frame segment.

In accordance with one or more example embodiments, such as embodiments discussed with respect to FIG. 23, roll-lock tabs of joist spacers 1602, 1604, 1608, and 1610 can be positioned with one of two roll-lock tab receivers within a box-frame segment configured like extrusion 875. The box-frame segment configured like extrusion 875 can be a box-frame segment of a box-frame within deck system 704 or 705. The locking tabs of the box-frame segment and the locking tab retainers of joist spacers 1602, 1604, 1608, and 1610 are used for attachment of those joist spacers.

Deck clips 5 and deck clip screws 92 can be positioned within joist segments 1412 and 1616. FIG. 16 also shows positions of edges 6A of deck boards 6 attachable to deck systems 704 or 715.

Figure 17:
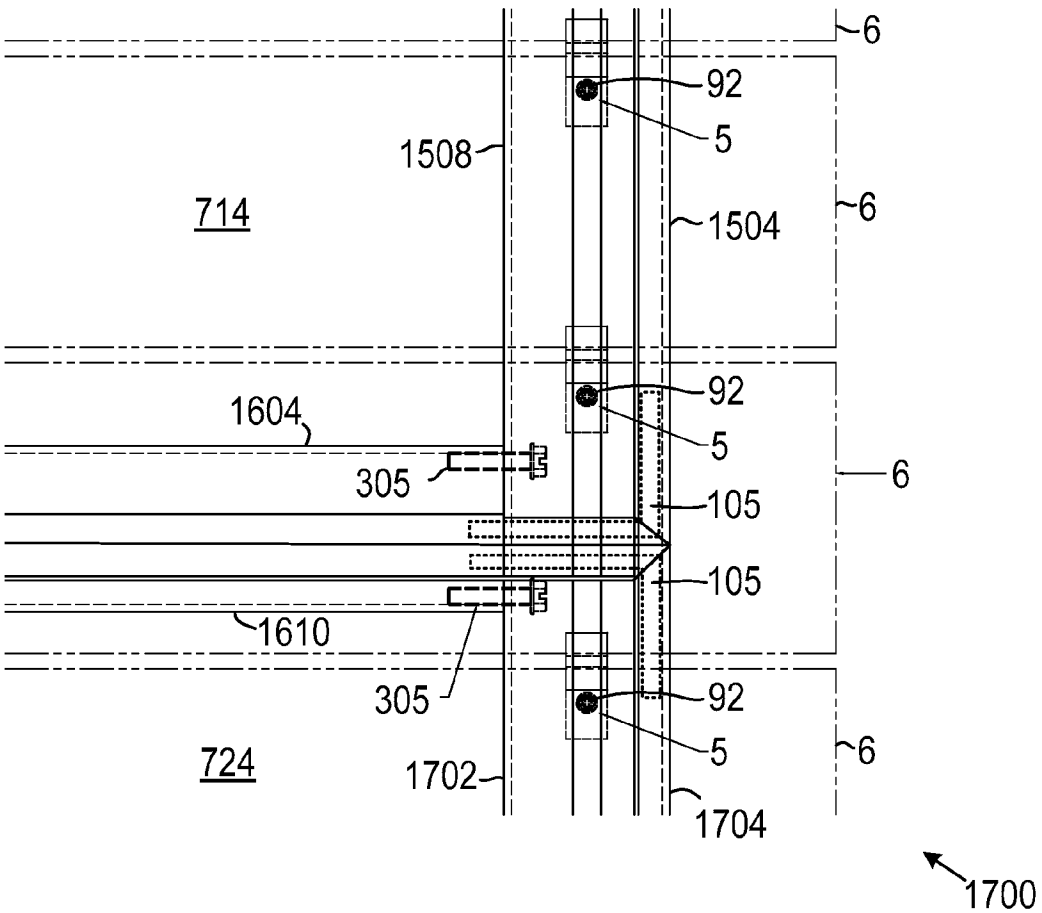

Next, FIG. 17 is a large-scale view of a portion 1700 of deck system 700 shown in FIG. 7. Portion 1700 includes elements of joist assemblies 714 and 724, and box-frame segments 1504 and 1704, of box-frames of deck systems 704 and 705, respectively. Box-frame segment 1704, similar to box-frame 1504, can be configured like extrusion 800.

Joist assembly 714 includes a joist spacer 1604 configured like extrusion 850, and joist segment 1508 configured like extrusion 825 or 850. Joist spacer 1604 and joist segment 1508 can attach to one another using one or more fasteners 902. Joist assembly 714 can be the last joist assembly installed into deck system 704 during assembly and the first joist assembly removed from deck system 704 during disassembly of deck system 704.

Joist assembly 724 includes a joist spacer 1610 configured like extrusion 850, and a joist segment 1702 configured like extrusion 825 or 850. Joist spacer 1610 and joist segment 1702 can attach to one another using one or more fasteners 902. Joist assembly 724 can be the last joist assembly installed into deck system 705 during assembly and the first joist assembly removed from deck system 705 during disassembly of deck system 705.

Angle clips 105 can be inserted into box-frame segments 1504 and 1704 for attaching to box-frame segments configured like extrusion 800. Alternatively, an angle clip 105 can be inserted into box-frame segments 1504 and 1704 and into a box-frame segment configured like extrusion 875. Deck clips 5 and deck clip screws 92 are positioned within joist segments 1508 and 1702. FIG. 17 also shows positions of deck boards 6 attachable to deck system 700.

Figure 18:
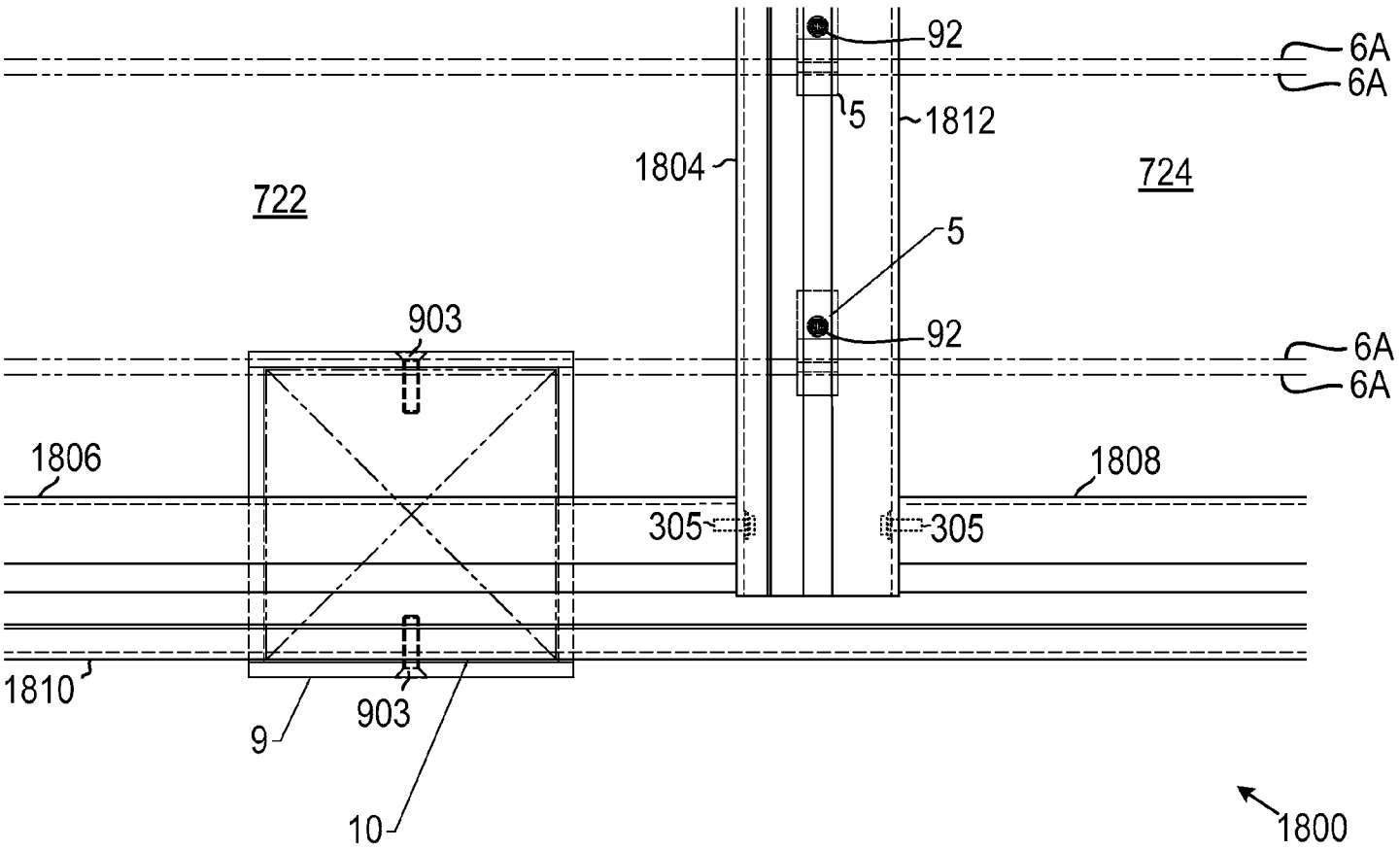

Next, FIG. 18 is a large-scale view of a portion 1800 of deck system 700 shown in FIG. 7. Portion 1800 includes elements of joist assemblies 722 and 724.

Joist assembly 722 includes a joist spacer 1806 configured like extrusion 800 and a joist segment 1614 configured like extrusion 800. Joist spacer 1806 and joist segment 1614 can attach to one another using one or more fasteners 902.

Joist assembly 724 includes a joist spacer 1808 configured like extrusion 850 and a joist segment 1616 configured like extrusion 850. Joist spacer 1808 and joist segment 1616 can attach to one another using one or more fasteners 902. Joist assembly 724 can be the last joist assembly installed into deck system 705 during assembly and the first joist assembly removed from deck system 705 during disassembly of deck system 705.

In accordance with one or more example embodiment, roll-lock tabs of joist spacers 1806 and 1808 can be positioned within a roll-lock tab receiver of a box-frame segment 1810 of deck system 705. Box-frame segment 1810 can be configured like extrusion 800. The locking tab of the box-frame segment 1810 and the locking tab retainers of joist spacers 1806 and 1808 are used for attachment of joist spacers 1806 and 1808 to box-frame segment 1810.

An intermediate-post bracket 9 attached to post 10 using fasteners 903 is shown in FIG. 18. Intermediate-post bracket 9 can be attached to box-frame segment 1810 using one or more fasteners 903 or another type of fastener. In an alternative embodiment, the intermediate-post bracket 9 shown in FIG. 18 can be replaced with an intermediate-post bracket 64 and support ring 1012 to accommodate a railing post and railing attachable to deck system 700. Deck clips 5 and deck clip screws 92 are positioned within joist segment 1616. FIG. 18 shows positions of edges 6A of deck boards 6 attachable to deck system 700.

Figure 19:
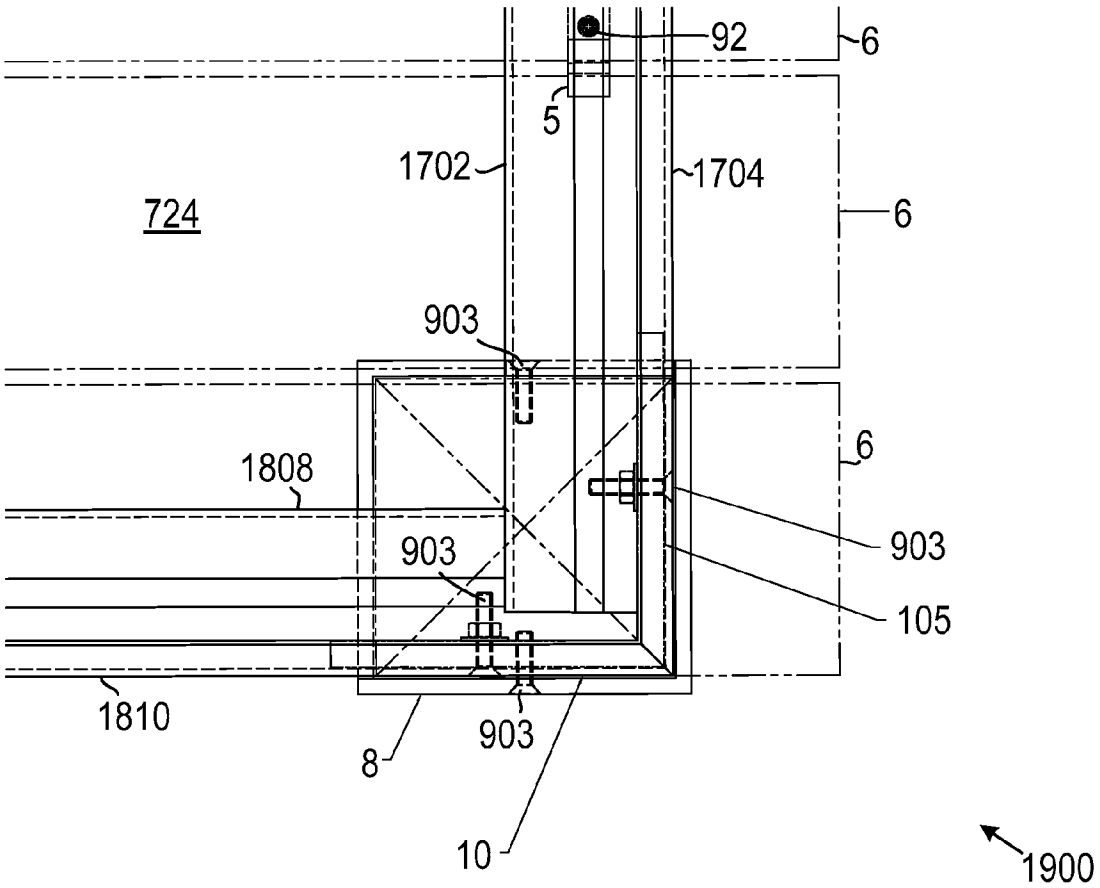

Next, FIG. 19 is a large-scale view of a portion 1900 of deck system 700 shown in FIG. 7. Portion 1900 includes elements of joist assembly 724 and box-frame segments 1704 and 1810 of box-frames of deck system 705. Box-frame segments 1704 and 1810 can be configured like extrusion 800. Box-frame segments 1704 and 1810 can attach to one another using angle clip 105, and angle clip 105 can attach to box-frame segments 1704 and 1810 using one or more fasteners 903 installed into screw splines of box-frame segments 1704 and 1810.

Joist assembly 724 includes joist spacer 1804 configured like extrusion 850, and joist segment 1702 configured like extrusion 825 or 850. Joist assembly 724 can be the last joist assembly installed into deck system 705 during assembly and the first joist assembly removed from deck system 705 during disassembly of deck system 705. A corner-post bracket 8 attached to post 10 using fasteners 903 is shown in FIG. 19.

Corner-post bracket 8 can be attached to box-frame segments 1704 and 1810 using one or more fasteners 903 or another type of fastener. In an alternative embodiment, the corner-post bracket 9 shown in FIG. 19 can be replaced with a corner-post bracket 62 and support ring 1094 to accommodate a railing post and railing attachable to deck system 700. A deck clip 5 and deck clip screw 92 are positioned within extrusion 1702. FIG. 19 shows positions of deck boards 6 attachable to deck system 700.

Figure 20:
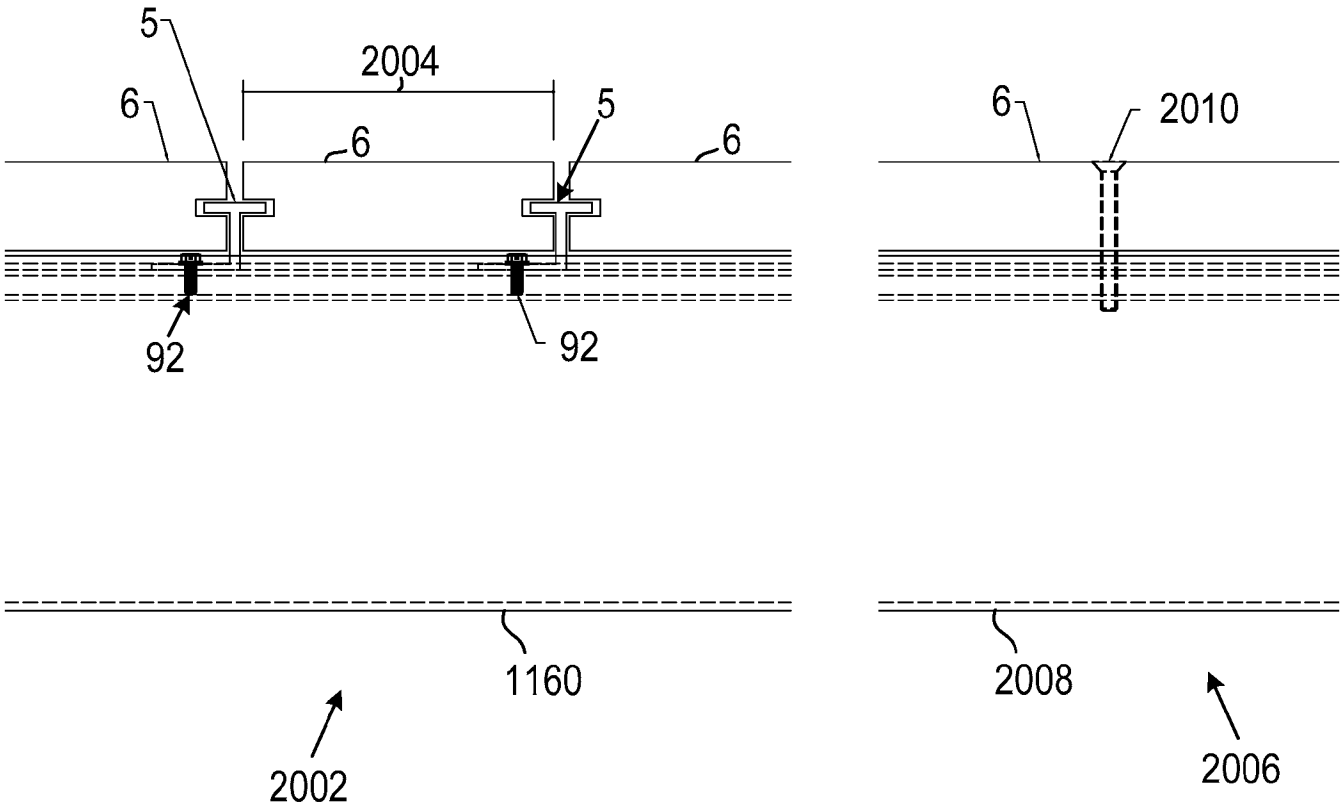
FIG. 20 shows partial section views with respect to section lines shown in FIG. 11.

Next, FIG. 20 shows a partial section view 2002 with respect to section lines 2000 shown in FIG. 11. The partial view 2002 shows deck clips 5 secured to joist segment 1160 using fasteners 92. The deck clips 5 provide for spacing for deck boards 6 and for attachment of deck boards 6 to joist segment 1160. FIG. 20 shows an alternative partial section view 2006 showing a deck board 6 attached to an extrusion 2008, such as a joist segment, using a deck screw 2010. Deck screws 2010 provide an alternative manner for attaching deck boards 6 to a deck system.

III. Assembly and Disassembly of Deck System

Figure 24:
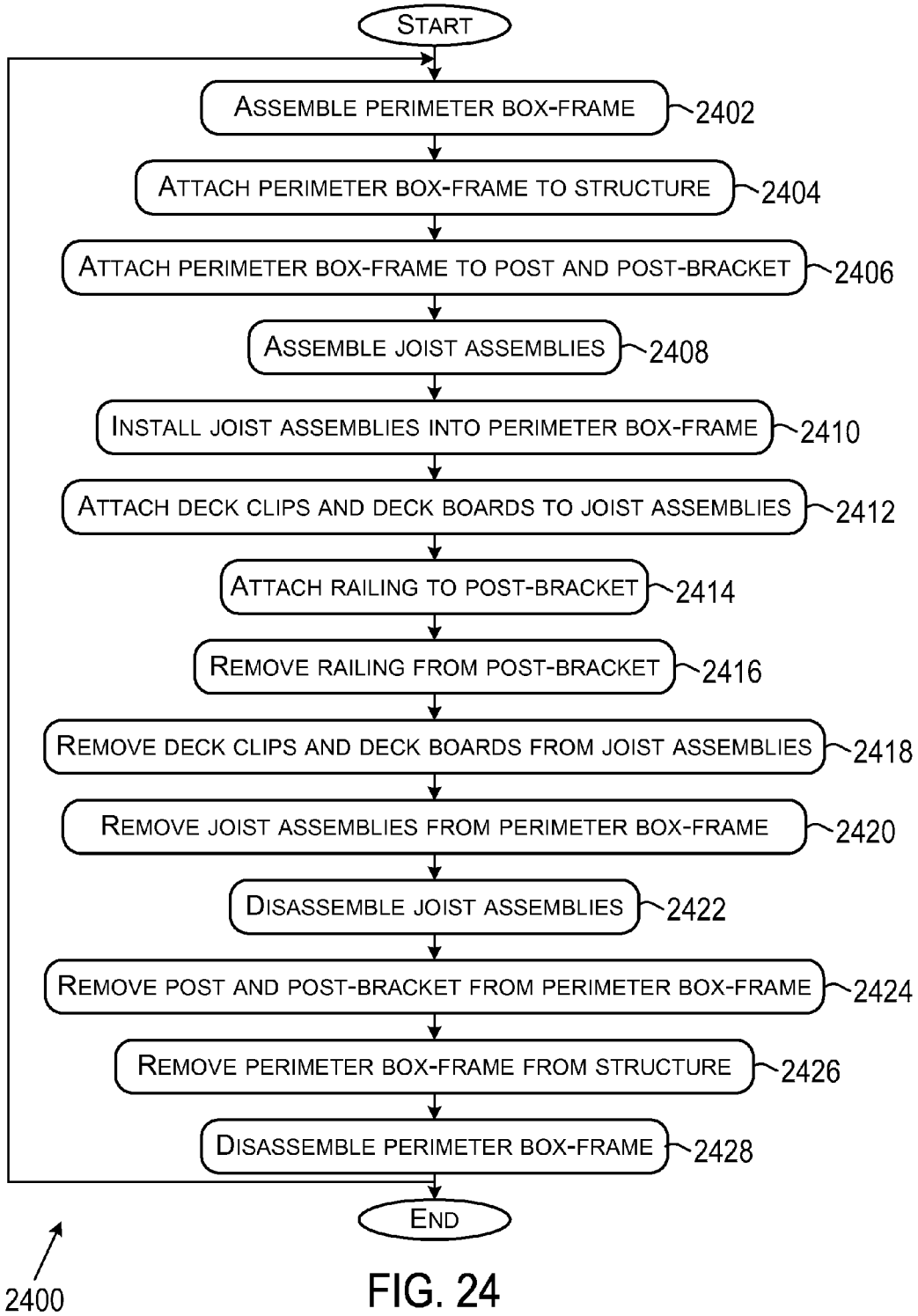
FIG. 24 is a flow chart showing steps for assembling and disassembling a deck system. The items shown in the figures are not or may not be to scale.

FIG. 24 is a flow chart showing example set of steps 2400 that can be carried out to assemble and disassemble a deck system in accordance with one or more example embodiments. One or more of the steps (shown in blocks numbered with even numbers between 2402 and 2428, inclusive) or portions of the steps of the set 2400 are not required for each and every example embodiment. The steps shown in the set 2400 can be carried out in various arrangements, and one or more of the steps can be repeated.

Block 2402 includes assembling perimeter box-frame. Assembling the box-frame can include inserting angle clips into box-frame segments. Each angle clip can be inserted into two box-frame segments to form a rectangular box-frame. Fasteners can be inserted into the angle clips and box-frame segments to more securely attach two box-frame segments together.

Next, block 2404 includes attaching perimeter box-frame to structure. Attaching the box-frame can include drilling holes within one or more box-frame segments and into the structure. Shims can be placed between the structure and the box-frame to provide spacing, as necessary, between the structure and the deck system being attached to the structure. Fasteners 310 and 312 can be inserted into holes within the box-frame and the structure for attachment of the box-frame and the structure.

Next, block 2406 includes attaching the perimeter box-frame to post and post bracket. A support post can be positioned upon a footing, such as a concrete footing. A post bracket, such as corner-post bracket or an intermediate-post bracket, can be attached to the support post using fasteners, such as fasteners 903. The post bracket can be attached to a box-frame segment of the box-frame using fasteners, such as fasteners 903.

Next, block 2408 includes assembling joist assemblies. Assembling the joist assemblies can include attaching two joist spacers to two joist segments. The joist spacers can be configured like extrusion 850. The joist segments can be configured like extrusions 800 and 825. If N quantity of joists are to be assembled, N−1 joist can be configured like joist assembly 300, and one joist can be configured like joist assembly 320. Fasteners 305 can be used to attach a joist spacer to a joist segment.

Next, block 2410 includes installing joist assemblies into perimeter box-frame. Assembling the joist assemblies can include, starting at one side of the box-frame, installing each joist assembly configured like joist assembly 300 until the remaining space in the interior of the box-frame and at the opposite side of the box-frame, and then installing the joist assembly configured like joist assembly 320 into the remaining space. Installing each joist assembly until the installing the last joist assembly can include roll-lock tabs being positioned into roll-lock tab receivers at the attachment points of three box-frame segments and two joist spacers and a joist segment of a joist assembly or at the attachment points of two box-frame segments and a joist segment of a previously-installed joist assembly and two joist spacers and a joist segment of a joist assembly. Installing the last joist assembly can include roll-lock tabs being positioned into roll-lock tab receivers at the attachment points of three box-frame segments and a joist segment of a previously-installed joist assembly, and two joist segments and two joist spacers of the joist assembly.

Next, block 2412 includes attaching deck clips and deck boards to the joist assemblies. Attaching the deck clips can include inserting the deck clips 5 into deck clip slots 837 within a joist segment configured like extrusion 825 or 850, and securing the inserted deck clip 5 using a deck clip screw 92. A plurality of each deck board can be retained, at least in part, by deck board retaining surfaces 135 and 137 of a plurality of deck clips. Additionally or alternatively, deck boards can be attached to the joist assemblies using deck screws 2010.

Next, block 2414 includes attaching railing to post bracket. Attaching the railing can include attaching a railing post 60 within a corner-post bracket 64 or within an intermediate-post bracket 62 and within a support ring 1012 or 1094 using fasteners 903. A support bracket 1014 can be attached to a support post 10 and the railing post 60 using fasteners 903. Any of a variety of railing components can be attached to and between two railing posts 60

Next, block 2410 includes removing the railing from the post bracket. Removing the railing from the post bracket can include removing any components attached to and between two railing posts, removing fasteners attaching the railing post 60 to post brackets, support ring, and support brackets and then removing the railing post from the brackets and from the deck system.

Next, block 2418 includes removing deck clips and deck boards from the joist assemblies. Removing the deck clips and deck boards can including removing any deck screws that attach the deck boards to the joist assemblies. Removing the deck boards can include sliding the each deck board away from the deck board retaining surfaces that are retaining the deck board. Removing the deck clips can include removing the deck clip screws 92 that retain the deck clip to the joist assemblies.

Next, block 2420 includes removing joist assemblies from the perimeter box-frame. Removing the joist assemblies can include removing the joist assemblies in a reverse order in which the joist assemblies were installed into the box-frame. In other words, the joist assemblies can be removed using a last-in-first-out procedure.

Next, block 2422 includes disassembling joist assemblies. Disassembling the joist assemblies can include removing fasteners placed into a joist spacer and joist segment pair, and then separating the joist spacer from the joist segment. Next, block 2424 includes removing post and post bracket from perimeter box-frame.

Removing the box-frame from the post and post bracket can include removing the fasteners that attach the post and post bracket to a box-frame segment. The post bracket can be removed from the post. In accordance with some example embodiments, the post can be removed from the footer.

Next, block 2426 includes removing perimeter box-frame from structure. Removing the box-frame can include removing fasteners 310 and 312 and shims used to attach the box-frame and the structure.

Next, block 2428 includes disassembling perimeter box-frame. Disassembling the box-frame can include removing any fasteners that secure two box-frame segments. Disassembling the box-frame can include removing angle clips from the box-frame segments.

IV. Conclusion

Example embodiments have been described above. Those skilled in the art will understand that changes and modifications can be made to the described embodiments without departing from the true scope and spirit of the present invention, which is defined by the claims.

I claim:

1. A joist assembly comprising:

a first joist spacer including a first end of the first joist spacer, a second end of the first joist spacer, and a roll-lock tab between the first end of the first joist spacer and the second end of the first joist spacer;

a second joist spacer including a first end of the second joist spacer, a second end of the second joist spacer, and a roll-lock tab between the first end of the second joist spacer and the second end of the second joist spacer;

a first joist segment removably attached to the first joist spacer at the first end of the first joist spacer and to the second joist spacer at the first end of the second joist spacer; and a second joist segment removably attached to the second joist spacer at the second end of the second joist spacer and to the second joist spacer at the second end of the second joist spacer.

2. The joist assembly of claim 1, wherein the roll-lock tab of the first joist spacer is configured for positioning within a roll-lock tab receiver of a first box-frame segment, and wherein the roll-lock tab of the second joist spacer is configured for positioning within a roll-lock tab receiver of a second box-frame segment.

3. The joist assembly of claim 1, wherein the first joist spacer comprises a first extrusion, wherein the second joist spacer comprises a second extrusion, wherein the first joist segment comprises a third extrusion, and wherein the second joist segment comprises a fourth extrusion.

4. The joist assembly of claim 3, wherein each of the first extrusion, the second extrusion, the third extrusion, and the fourth extrusion comprises a separate aluminum extrusion.

5. The joist assembly of claim 1, wherein the first joist segment includes a first end of the first joist segment and a second end of the first joist segment, and a roll-lock tab between the first end of the first joist segment and the second end of the first joist segment, and wherein the second joist segment includes a first end of the second joist segment and a second end of the second joist segment, and a roll-lock tab receiver between the first end of the second joist segment and the second end of the second joist segment.

6. The joist assembly of claim 5, wherein the first joist segment includes a vertical portion, a first horizontal portion, and a second horizontal portion, wherein the first horizontal portion extends from an upper-most part of the vertical portion, wherein the second horizontal portion extends from a lower-most part of the vertical portion, wherein the first horizontal portion includes a first top horizontal surface, and wherein the second horizontal portion includes a bottom horizontal surface.

7. The joist assembly of claim 6, wherein the first horizontal portion includes a second top horizontal surface and a deck clip slot positioned between the first top horizontal surface and the second top horizontal surface.

8. The joist assembly of claim 7, further comprising;

one or more deck clips placed into the deck clip slot.

9. The joist assembly of claim 8, wherein the first horizontal portion includes a threaded screw slot accessible through the deck clip slot, and wherein at least one of the deck clips placed into the deck clip slot is removably attachable to the first joist segment with a fastener positioned into a through-hole in the deck clip and into the threaded screw slot.

10. The joist assembly of claim 6, wherein the second horizontal surface includes a locking tab retainer configured to attach to a locking tab of another joist segment or to a locking tab of a box frame segment.

11. The joist assembly of claim 5, wherein the second joist segment includes a vertical portion, a first horizontal portion, and a second horizontal portion, wherein the first horizontal portion extends from an upper-most part of the vertical portion, wherein the second horizontal portion extends from a lower-most part of the vertical portion, wherein the first horizontal portion includes a first top horizontal surface that extends from the vertical portion to the roll-lock tab receiver, and wherein the second horizontal portion includes a locking tab configured for releasably attaching to a locking tab retainer.

12. The joist assembly of claim 1, wherein the first joist segment includes a first end of the first joist segment and a second end of the first joist segment, and a roll-lock tab between the first end of the first joist segment and the second end of the first joist segment, wherein the second joist segment includes a first end of the second joist segment and a second end of the second joist segment, and a roll-lock tab between the first end of the second joist segment and the second end of the second joist segment, and wherein the roll-lock tab of the second joist segment is shorter than the roll-lock tab of the first joist segment to allow the joist assembly to be a final joist assembly insertable into an end of a box-frame assembly and removable from the box-frame assembly.

13. The joist assembly of claim 1, further comprising:

a plurality of fasteners including at least a first fastener and a second fastener, wherein the first joist spacer includes a first screw spline, wherein the second joist spacer includes a second screw spline, wherein the first fastener is removably positioned into the first joist segment and into the first screw spline, and wherein the second fastener is removably positioned into the first joist segment and into the second screw spline.

14. The joist assembly of claim 13, wherein the first screw spline extends from the first end of the first joist spacer to the second end of the first joist spacer, and wherein the second screw spline extends from the first end of the second joist spacer to the second end of the second joist spacer.

15. The joist assembly of claim 14, wherein the plurality of fasteners includes a third fastener and a fourth fastener, wherein the first joist spacer includes a third screw spline, wherein the second joist spacer includes a fourth screw spline, wherein the third fastener is removably positioned into the first joist segment and into the third screw spline, and wherein the fourth fastener is removably positioned into the first joist segment and into the fourth screw spline.

16. A method of assembling a joist assembly, comprising:

attaching a first end of a first joist spacer to a first joist segment;

attaching a second end of the first joist spacer to a second joist segment, wherein the first joist spacer includes a roll-lock tab between the first end of the first joist spacer and the second end of the first joist spacer;

attaching a first end of a second joist spacer to the first joist segment; and attaching a second end of the second joist spacer to the second joist segment, wherein the second joist spacer includes a roll-lock tab between the first end of the second joist spacer and the second end of the second joist spacer.

17. The method of assembling the joist assembly of claim 16, wherein the first joist spacer includes a first screw spline, wherein the second joist spacer includes a second screw spline, wherein attaching the first end of the first joist spacer to the first joist segment includes removably positioning a first fastener into the first joist segment and into the first screw spline, and wherein attaching the first end of the second joist spacer to the first joist segment includes removably positioning a second fastener into the first joist segment and into the second screw spline.

18. The method of assembling the joist assembly of claim 17, wherein attaching the second end of the first joist spacer to the second joist segment includes removably positioning a third fastener into the second joist segment and into the first screw spline, and wherein attaching the second end of the second joist spacer to the second joist segment includes removably positioning a fourth fastener into the second joist segment and into the second screw spline.

19. The method of assembling the joist assembly of claim 16, wherein the first joist segment includes a first end of the first joist segment and a second end of the first joist segment, and a roll-lock tab between the first end of the first joist segment and the second end of the first joist segment, and wherein the second joist segment includes a first end of the second joist segment and a second end of the second joist segment, and a roll-lock tab receiver between the first end of the second joist segment and the second end of the second joist segment.

20. The method of assembling the joist assembly of claim 16, wherein the first joist segment includes a first end of the first joist segment and a second end of the first joist segment, and a roll-lock tab between the first end of the first joist segment and the second end of the first joist segment, wherein the second joist segment includes a first end of the second joist segment and a second end of the second joist segment, and a roll-lock tab between the first end of the second joist segment and the second end of the second joist segment, and wherein the roll-lock tab of the second joist segment is shorter than the roll-lock tab of the first joist segment to allow the joist assembly to be a final joist assembly insertable into an end of a box-frame assembly and removable from the box-frame assembly.

* * * * *